US012274311B2

(12) United States Patent
Watanabe

(10) Patent No.: US 12,274,311 B2
(45) Date of Patent: Apr. 15, 2025

(54) HEATED AROMA-PRODUCING BODY, AROMA CARTRIDGE, AND MANUFACTURING METHOD AND MANUFACTURING DEVICE FOR HEATED AROMA-PRODUCING BODY

(71) Applicant: Future Technology Co., Ltd., Kagoshima (JP)

(72) Inventor: Ryuji Watanabe, Tokyo (JP)

(73) Assignee: Future Technology Co., Ltd., Izumi (JP)

( * ) Notice: Subject to any disclaimer, the term of this patent is extended or adjusted under 35 U.S.C. 154(b) by 511 days.

(21) Appl. No.: 17/531,201

(22) Filed: Nov. 19, 2021

(65) Prior Publication Data

US 2022/0071305 A1 Mar. 10, 2022

Related U.S. Application Data

(63) Continuation of application No. PCT/JP2019/020644, filed on May 24, 2019.

(30) Foreign Application Priority Data

May 21, 2019 (JP) ..... 2019-095531

(51) Int. Cl.
*A24F 40/70* (2020.01)
*A24B 15/14* (2006.01)
(Continued)

(52) U.S. Cl.
CPC ..... *A24F 40/70* (2020.01); *A24B 15/14* (2013.01); *A24B 15/167* (2016.11); *A24C 5/01* (2020.01);
(Continued)

(58) Field of Classification Search
CPC ..... A24F 40/20; A24F 40/46; A24F 40/42; A24F 40/40; A24F 40/465; A24F 1/00; A24F 23/02; A24F 25/00; A24F 15/00
See application file for complete search history.

(56) References Cited

U.S. PATENT DOCUMENTS 1,559,322 A 10/1925 Hohn
3,820,548 A 6/1974 Buchmann
(Continued)

FOREIGN PATENT DOCUMENTS

CN 101474409 A 7/2009
CN 108077992 A 5/2018
(Continued)

OTHER PUBLICATIONS

International Search Report issued in Intl. Appln. No. PCT/JP2019/020644 mailed Sep. 17, 2019. English translation provided.
(Continued)

*Primary Examiner* — Truc T Nguyen
(74) *Attorney, Agent, or Firm* — Yokoi & Co., U.S.A.; Toshiyuki Yokoi

(57) ABSTRACT

The present disclosure provides an aroma-producing body to be heated and an aromatic cartridge equipped therewith, as well as a manufacturing method and a manufacturing device for the heated aromatic producing body. The aroma-producing body to be heated includes an aroma-producing substrate to be heated and a packaging material winding up the aroma-producing substrate to be heated. The aroma-producing body to be heated has a gas flow path of voids formed by the aggregation of heated aromatic producing substrates into primary aggregates, and a gas flow path of voids formed by the aggregation of the aroma-producing substrate to be heated and the primary aggregate thereof into a secondary aggregate, and a gas flow path of voids formed by the heated aromatic producing substrate and its primary aggregate in
(Continued)

contact with the packaging material. These gas paths have a deformed gas flow path that penetrates the aroma-producing body to be heated.

8 Claims, 12 Drawing Sheets

(51) Int. Cl.

| | |
|---|---|
| ***A24B 15/167*** | (2020.01) |
| ***A24C 5/01*** | (2020.01) |
| ***A24C 5/39*** | (2006.01) |
| ***A24D 3/17*** | (2020.01) |
| ***A24F 40/20*** | (2020.01) |
| ***A24F 40/485*** | (2020.01) |

(52) U.S. Cl.
CPC ..... *A24C 5/399* (2013.01); *A24D 3/17* (2020.01); *A24F 40/20* (2020.01); *A24F 40/485* (2020.01)

(56) References Cited

U.S. PATENT DOCUMENTS

| | | | | |
|---|---|---|---|---|
| 4,889,143 | A | 12/1989 | Pryor | |
| 5,065,776 | A | 11/1991 | Lawson et al. | |
| 6,053,176 | A | 4/2000 | Adams et al. | |
| 2001/0003987 | A1 | 6/2001 | Okumoto | |
| 2007/0186945 | A1 | 8/2007 | Olegario | |
| 2007/0240726 | A1 | 10/2007 | Sendo et al. | |
| 2012/0006343 | A1 | 1/2012 | Renaud et al. | |
| 2014/0366901 | A1 | 12/2014 | Shinozaki | |
| 2017/0145598 | A1 | 5/2017 | Meinecke | |
| 2018/0177228 | A1 | 6/2018 | Pijnenburg et al. | |
| 2019/0124981 | A1 | 5/2019 | Fursa | |
| 2020/0060341 | A1* | 2/2020 | Sebastian | A24F 40/465 |
| 2020/0128880 | A1* | 4/2020 | Gage | A24B 15/167 |
| 2020/0237018 | A1* | 7/2020 | Sur | H05B 6/36 |
| 2020/0337363 | A1 | 10/2020 | Qian | |
| 2021/0368859 | A1* | 12/2021 | Watanabe | A24D 1/18 |

FOREIGN PATENT DOCUMENTS

| | | | | |
|---|---|---|---|---|
| DE | 10145327 | A1 | 4/2003 | |
| EP | 2967155 | B1 | 3/2017 | |
| EP | 3469922 | A1 | 4/2019 | |
| JP | S5314640 | B2 | 5/1978 | |
| JP | S62272962 | A | 11/1987 | |
| JP | H06109715 | A | 4/1994 | |
| JP | H10108659 | A | 4/1998 | |
| JP | 2005232619 | A | 9/2005 | |
| JP | 2008518614 | A | 6/2008 | |
| JP | 2010520764 | A | 6/2010 | |
| JP | 2013519384 | A | 5/2013 | |
| JP | 2014076370 | A | 5/2014 | |
| JP | 2015536673 | A | 12/2015 | |
| JP | 2016528930 | A | 9/2016 | |
| JP | 6017546 | B2 | 11/2016 | |
| JP | 2016189700 | A | 11/2016 | |
| JP | 2016538848 | A | 12/2016 | |
| JP | 2017500852 | A | 1/2017 | |
| JP | 2017506891 | A | 3/2017 | |
| JP | 2017519915 | A | 7/2017 | |
| JP | 2017524368 | A | 8/2017 | |
| JP | 6280287 | B1 | 2/2018 | |
| JP | 2018509917 | A | 4/2018 | |
| KR | 1020180125597 | A | 11/2018 | |
| RU | 1836038 | A3 | 8/1993 | |
| RU | 2352228 | C1 | 4/2009 | |
| RU | 2639117 | C1 | 12/2017 | |
| WO | 0007466 | A1 | 2/2000 | |
| WO | 2006048774 | A1 | 5/2006 | |
| WO | 2008037470 | A1 | 4/2008 | |
| WO | 2008110932 | A2 | 9/2008 | |
| WO | 2011101164 | A1 | 8/2011 | |
| WO | 2012164009 | A2 | 12/2012 | |
| WO | 2013094681 | A1 | 6/2013 | |
| WO | 2014086999 | A1 | 6/2014 | |
| WO | 2015035311 | A1 | 3/2015 | |
| WO | 2015082649 | A1 | 6/2015 | |
| WO | 2015101595 | A1 | 7/2015 | |
| WO | 2015128028 | A1 | 9/2015 | |
| WO | 2016023965 | A1 | 2/2016 | |
| WO | 2016156223 | A1 | 10/2016 | |
| WO | WO 2017178394 | * | 10/2017 | A24F 42/60 |
| WO | 2017198837 | A1 | 11/2017 | |
| WO | 2017207672 | A1 | 12/2017 | |
| WO | 2018087869 | A1 | 5/2018 | |
| WO | 2018114848 | A1 | 6/2018 | |
| WO | 2019030276 | A1 | 2/2019 | |
| WO | 2019057796 | A1 | 3/2019 | |
| WO | 2020012761 | A1 | 1/2020 | |
| WO | 2020013339 | A1 | 1/2020 | |

OTHER PUBLICATIONS

Written Opinion issued in Intl. AppIn. No. PCT/JP2019/020644 mailed Sep. 17, 2019. English translation provided.
Office Action issued in Japanese Appln. No. 2019-096302 mailed Sep. 10, 2019. English machine translation provided.
Office Action issued in Japanese Appln. No. 2019-096302 mailed Feb. 12, 2020. English machine translation provided.
Decision to Grant a Patent issued in Japanese Appln. No. 2019-096302 mailed Apr. 14, 2020. English machine translation provided.
International Search Report issued in Intl. Appln. No. PCT/JP2019/027819 mailed Oct. 15, 2019. English translation provided.
Written Opinion issued in Intl. Appln. No. PCT/JP2019/027819 mailed Oct. 15, 2019. English translation provided.
Office Action issued in Japanese Appln. No. 2020-142012 mailed Apr. 20, 2021. English machine translation provided.
Office Action issued in Japanese Appln. No. 2020-142012 mailed Jun. 8, 2021. English machine translation provided.
Decision of Refusal issued in Japanese Appln. No. 2020-142012 mailed Aug. 3, 2021. English machine translation provided.
Office Action issued in Japanese Appln. No. 2021-074388 mailed May 18, 2021. English machine translation provided.
Office Action issued in Japanese Appln. No. 2021-074388 mailed Jun. 29, 2021. English machine translation provided.
Office Action issued in Japanese Appln. No. 2019-086909 mailed May 28, 2019. English machine translation provided.
Office Action issued in Japanese Appln. No. 2019-086909 mailed Jul. 16, 2019. English machine translation provided.
Decision to Grant a Patent issued in Japanese Appln. No. 2019-086909 mailed Feb. 12, 2020. English machine translation provided.
International Search Report issued in Intl. Appln. No. PCT/JP2019/018053 mailed Jun. 4, 2019. English translation provided.
Written Opinion issued in Intl. Appln. No. PCT/JP2019/018053 mailed Jun. 4, 2019. English translation provided.
Office Action issued in Russian Appln. No. 2021134533 mailed on Jun. 2, 2022. English translation provided.
English machine translation of Japanese Publication No. H06-109715, previously cited in IDS filed Jan. 24, 2022.
Office Action issued in Japanese Appln. No. 2020-530291 mailed Aug. 22, 2023. English translation provided.
Extended European Search Report issued in European Appln. No. 19929731.8 mailed Oct. 27, 2023.
Office Action issued in Japanese Appln. No. 2020-530291 mailed on May 9, 2023. English machine translation provided.
Office Action issued in Japanese Appln. No. 2021-520034 mailed on Mar. 28, 2023. English machine translation provided.
Office Action issued in Korean Application No. 10-2021-7040308 mailed May 29, 2024. English translation provided.

* cited by examiner

HEATED AROMA-PRODUCING BODY, AROMA CARTRIDGE, AND MANUFACTURING METHOD AND MANUFACTURING DEVICE FOR HEATED AROMA-PRODUCING BODY

CROSS REFERENCE TO RELATED APPLICATIONS

This application is a U.S. continuation application filed under 35 U.S.C. § 111 (a), of International Application No. PCT/JP2019/020644, filed on May 24, 2019, which claims priority to Japanese Patent Application No. 2019-095531, filed on May 21, 2019, the disclosures of which are incorporated herein by reference.

FIELD

The present invention relates to an aroma-producing body to be heated, an aroma cartridge, which are mounted in a chamber provided with an electrically controlled heating element of a heated smoking device so as to be in contact with a heating element, and which can exhibit the smoke and the aroma component of an aerosol generated by heating the heating element, and a manufacturing method and manufacturing device for the aroma-producing body to be heated.

BACKGROUND

In recent years, smoking cessation of tobacco has become widespread in spaces including workplaces, restaurants, and the like, where people of all ages gather, and while the number of smokers of who burn the tobacco with a flame has been rapidly decreasing, the number of smokers of electronic tobacco cartridges having an aerosol-producing body containing an aerosol former that generates an aerosol by heat using a heated smoking device having an electrically controlled heating element in a chamber has been rapidly increasing. Accordingly, various electronic tobacco products have been sold to enjoy heated smoking. The reason for this is that this heating-type smoking reduces the inhalation of harmful components produced by the thermal decomposition and burning of conventional tobacco. Therefore, technology development on electronic tobacco products has been actively carried out (for example, Japanese laid-open patent publication No. 2008-518614, Japanese laid-open patent publication No. 2010-520764, Japanese laid-open patent publication No. 2013-519384, Japanese laid-open patent publication No. 2016-538848, and Japanese patent No. 6280287).

Although the mechanism of such heated smoking varies depending on the form of the heated smoking device or the electronic tobacco cartridge and the like, a typical example is shown below. When an electronic tobacco cartridge with an aerosol-producing body at one end and a mouthpiece at the other end is mounted and heated so as to contact the aerosol-producing body with a heat source of a heating smoking device, volatiles containing an aerosol former are released from the aerosol-producing body, and the volatiles are inhaled into the mouthpiece side at the other end together with air by suction of the smoker at the same time. In this volatile conveying process, the volatiles of the aerosol former are cooled and condensed to form a smoke-like aerosol. Along with this, other volatiles impart an aroma to the mouth and nose of the smoker. As a result, the smoker can enjoy smoking. Therefore, in the case of heated smoking, it is shown that smoking is capable at about 200 to 350° C. at which the aerosol former such as glycerin or propylene glycol contained in the aerosol-producing body can be volatilized, that is, at the temperature at which the thermal decomposition of the leaves of the tobacco starts.

On the other hand, in the case of conventional flame-type smoking in which tobacco is burned by flame, a temperature exceeding at least 600° C. is required for burning, and the maximum temperature may reach 900° C. when smoking. Generally, it is said that the number of harmful substances generated increases as the temperature rises. From this, it is understood that the number of harmful substances generated by heating-type smoking is extremely small.

In addition, the content of tobacco leaves in the aerosol-producing body is small, and the material design is applied accordingly. Also, tobacco stalks, leaf pieces, and tobacco dust and the like produced in the conventional tobacco production process can be used. As a result, effective utilization of materials and a reduction in material costs are achieved.

However, in the case of cigarette tobaccos, as described in Patent Literature 6, a method and a device for tobacco winding capable of forming a gas flow path suitable for smoking have been established. The tobacco winding device includes a chimney part for air-conveying the supplied cut tobacco upward, a suction part to which negative pressure for air-conveying the cut tobacco upward in the chimney part is supplied, and an endless tobacco band stretched between the chimney part and the suction part which is driven in synchronization with stringer tape. The tobacco winding device includes a cut feeding device. The cut feeding device adsorbs the cut tobacco to the lower surface of the tobacco band at the suction part. After that, the tobacco band adsorbing the cut tobacco is formed into a rod shape through a plurality of guides, and the rod-shaped cut tobacco is conveyed to a winding tube part. The tobacco winding device also includes a stringer tape that is fed and driven at a controlled speed. The tobacco winding device also includes winding tube part (paper winding part) on the stringer tape, which continuously winds rod-shaped cut tobaccos introduced from the cut feeding device onto a long wrapping paper continuously supplied from a roll. This device can be used to produce a large amount of tobacco having a gas flow path suitable for smoking.

An ecleter disk, which is provided in the middle of the plurality of guides of the travel path of the tobacco band from the chimney part of the cut feeding device toward the winding tube part for removing any excess of the cut tobacco adsorbed in the tobacco band plays an important role in adjusting the filling amount of the rod-shaped cut tobacco wound up by the winding tube part. Thereafter, the rod-shaped tobacco wound up with the wrapping paper in the winding tube part is cut to a desired length in the cutting unit and is supplied to a filter attachment in the next process. In the case of cigarette tobacco, cut tobacco has extremely diverse shapes, is bulky and elastic. Therefore, it is considered that such a tobacco winding method and device have been established.

On the other hand, an electronic tobacco cartridge includes an aerosol-producing body. The aerosol-producing body is heated by a heating element. The aerosol-producing body includes a composition which contains at least an aerosol former such as glycerin or propylene glycol and a tobacco plant and/or a non-tobacco plant, and a bonding agent. The aerosol-producing body is obtained by winding an aerosol-producing substrate up by paper, which is obtained by cutting a sheet which is formed and processed from the composition. Therefore, there are the following problems. In order to solve these problems, it is necessary to optimize the shape and size of the aerosol-producing substrate, and optimize the distribution and the filling rate of the aerosol-producing substrate in the aerosol-producing body, and the like, and to find a method and a device for winding up the aerosol-producing substrate with paper with an optimum hardness, and while various studies have been made (for example, Japanese laid-open patent publication No. 2013-519384, Japanese laid-open patent publication No. 2016-538848, and Japanese laid-open patent publication No. Sho 62-272962), no solution has yet been found.

First, unlike cigarette tobacco, there is a problem whereby it is extremely difficult to form a gas flow path suitable for smoking. The aerosol-producing substrate constituting the aerosol-producing body is obtained by cutting a sheet processed with a liquid aerosol former at room temperature, which is an essential component thereof, a tobacco plant and/or a non-tobacco plant, as well as a bonding agent and the like into a rod-shape, strip-shape, powder-shape, granular shape, pellet-shape, small flake-shape, sheet-shape, and fiber-like shapes. Therefore, when the aerosol-producing substrate is compared with cut tobacco constituting a cigarette tobacco, it is attributed to characteristics such as a high shape uniformity, a small bulk at the same weight, and a plastic material with poor elasticity.

Second, in the case of the electronic tobacco cartridge, it should not be burned when the aerosol-producing substrate and the heating element come into contact and inhaling. Therefore, there is a problem whereby the air flow temperature at the time of suction cannot be excessively increased.

Third, the electronic tobacco cartridge is attached to and detached from a heating-type smoking device. Therefore, it is necessary that the aerosol-producing body can be easily inserted into the heating element, and it is necessary to extract the aerosol-producing body from the heating element without the tobacco-forming substrate falling off.

SUMMARY

The aerosol-producing body is heated by a heating element. The aerosol-producing body includes a composition which contains at least an aerosol former such as glycerin or propylene glycol and a tobacco plant and/or a non-tobacco plant, and a bonding agent. The aerosol-producing body is obtained by winding an aerosol-producing substrate up by paper, which is obtained by cutting a sheet which is formed and processed from the composition. Therefore, there is a problem whereby it is difficult to increase the filling rate while securing the gas flow path due to the shape uniformity of the aerosol-producing substrate material, the large bulk specific gravity, and the poor elasticity. When a gas flow path capable of comfortably performing smoking is formed, a filling rate of an aerosol-producing substrate tends to be low, and there is a possibility that a problem of combustion at the time of suction and dropout at the time of attachment/detachment occurs. On the contrary, to solve the problem of combustion at the time of suction and dropout at the time of attachment/detachment, when the filling rate of the aerosol-producing substrate of the aerosol-producing body is increased, the gas flow rate inside the aerosol-producing body decreases. Because of this, smokers cannot inhale comfortably. Also, the number of inhaling per one piece of cigarette may increase, and may exceed the proper number of inhaling per the one piece of cigarette increase because the amount of inhaling decreases at a time. In addition, it becomes difficult to insert the aerosol-producing body into the heating element.

Therefore, the inventor of the present invention has found a method and a device for optimizing the shape and size of an aroma-producing substrate to be heated, optimizing the distribution and filling rate of the aroma-producing substrate to be heated in the aroma-producing body to be heated, and the like, and winding up the aroma-producing substrate to be heated with paper at an optimum hardness to solve the conflicting problems as described above and to increase the filling rate while securing a gas flow path, and has achieved the completion of the present invention.

That is, it is an object of the present invention to provide an aroma-producing body to be heated for an aroma cartridge and an aroma cartridge, which optimize a gas flow path and a filling rate, enables comfortably smoking, can secure an appropriate number of inhaling, and enables easy insertion of an aroma-producing body to be heated into a heating element of a heated aroma device without problems of combustion at the time of suction and dropout at the time of attachment/detachment, and a manufacturing method and a manufacturing device for the aroma-producing body to be heated.

In the present invention, the aerosol-producing substrate, the aerosol-producing body, the electronic tobacco cartridge, and the heating-type smoking device are, respectively, the aroma-producing substrate to be heated, the aroma-producing body to be heated, the aroma cartridge, and the heated aroma device, is based on the fact that smoking in the present invention is not limited to enjoying the smoking of an aerosol produced by heating the aerosol-producing substrate containing a tobacco component and the aerosol-producing body obtained by winding the aerosol-producing substrate up by paper, but smoking in the present invention includes enjoying an aroma of an aerosol produced by heating the aerosol-producing body which does not contain a tobacco component, and the aerosol-producing body. A cartridge referred to as "electronic tobacco compatible cartridge" is simply defined as "cartridge that can be used interchangeably (compatible) with an electronic tobacco cartridge containing a tobacco component," regardless of whether they contain a tobacco component or not.

That is, "smoking" generally means to inhale smoke which contains nicotine, tar, and the like, which are produced by burning or heating tobacco leaves of the Solanaceae genus tobacco or a material containing a tobacco component. However, in the present invention, "smoking" means "enjoy the smoke," "taste the smoke," and "satisfied with the smoke," and the elements of the smoke are not limited to those containing tobacco leaves or tobacco components, and only non-tobacco materials or non-tobacco components are also used. "Smoke" of the present invention also includes "what appears to be smoke" and "what is smoky", such as, for example, droplets dispersed in the air such as an aerosol. Further, the term "aroma" in the present invention means "good aroma" and includes a scent (fragrance) drifting from the material itself, a scent (aroma) drifting into the space when heated, and a scent (flavor) drifting into the mouth when inhaled, and the like.

The present invention is an aroma-producing body to be heated, which is inserted into an electrically controlled heating element provided in a chamber of a heated aroma device and provided in an aroma cartridge, includes an aroma-producing substrate to be heated, the aroma-producing substrate to be heated producing smoke and aromas when heated in contact with the heating element, and being wound up by a packaging material. The aroma-producing substrate to be heated includes at least an aerosol former, a tobacco plant and/or a non-tobacco plant, and a bonding agent. The aroma-producing substrate to be heated has a gas flow path of voids formed by the aggregation of heated aroma-producing substrates into primary aggregates, and a gas flow path of voids formed by the aggregation of the aroma-producing substrate to be heated and the primary aggregate thereof into a secondary aggregate, and a gas flow path of voids formed by the aroma-producing substrate to be heated and its primary aggregate in contact with the packaging material. These gas paths have a deformed gas flow path that penetrates the aroma-producing body to be heated. In the aroma-producing body to be heated having such a deformed gas flow path, the gas flow path is sufficiently secured. Therefore, it is possible to solve the problem of combustion of the aroma-producing substrate to be heated at the time of suction, and it is possible to comfortably inhale the smoke and aroma of a sufficient aerosol, and it is possible to easily insert into the heating element of the heated aroma device. On the other hand, since the filling rate of the aroma-producing substrate to be heated is high, it is possible to secure an appropriate number of inhaling, and also it is possible to avoid a problem of the aroma-producing substrate to be heated falling off when the aroma cartridge is attached/detached.

Further, in such a deformed gas flow path (233, 235 and 241 shown in FIG. 7), when the center region and the outer peripheral region are equally divided by area in a cross-section perpendicular to the longitudinal direction (11 shown in FIG. 1) of the aroma-producing body to be heated, it is preferable that the center region has a higher porosity than the outer peripheral region in order to exert the above-mentioned effects.

The aroma-producing substrate to be heated constituting such an aroma-producing body to be heated has a uniform cross-sectional shape perpendicular to the longitudinal direction, and the aspect ratio of the length of the long axis and the length of the short axis in the cross-section perpendicular to the longitudinal direction is preferably 1:1 to 30:1, more preferably 2:1 to 20:1, and still more preferably 5:1 to 20:1. However, when the aspect ratio between the length of the long axis and the length of the short axis is larger than 30:1, it is difficult to secure the gas flow path.

As can be understood from this aspect ratio, the cross-sectional shape perpendicular to the longitudinal direction of the aroma-producing substrate to be heated is not particularly limited, and it can be an isotropic regular triangle, a square, a regular polygon such as a regular pentagon, and a circle. However, the aspect ratio is preferably 2:1 or more, and it is preferably approximately rectangular and approximately elliptical to secure the deformed gas flow path.

In particular, it is most preferable that the aroma-producing substrate to be heated has a substantially rectangular parallelepiped cross-sectional shape so that a gap can be formed, and a gas flow path can be secured. Specifically, the length of the short axis of the cross-section perpendicular to the longitudinal direction of such a rectangular parallelepiped shape is preferably 0.1 to 1.0 mm, more preferably 0.1 to 0.5 mm. The length of the long axis of the cross-section perpendicular to the longitudinal direction of the rectangular parallelepiped shape is preferably 0.5 to 3.0 mm, more preferably 0.5 to 2.0 mm.

It is most preferable that the cross-sectional shape perpendicular to the longitudinal direction in the aroma-producing substrate to be heated is uniform in the longitudinal direction in order to secure uniformity in the longitudinal direction of the aroma-producing body to be heated, in which the aroma-producing substrate to be heated is wound up by the packaging material and in order for the gas flow path to penetrate the aroma-producing body to be heated.

On the other hand, the ratio between the length of the short axis and the length in the longitudinal direction in the cross-section perpendicular to the aroma-producing substrate to be heated constituting the aroma-producing body to be heated depends on the size of the chamber or the like of the heated aroma device in which the aroma cartridge is used. Therefore, the causal relationship with porosity in the cross-section perpendicular to the longitudinal direction of the aroma-producing body to be heated is poor. However, in order to obtain a pleasant suction using the aroma-producing body to be heated having the deformed gas flow path of the present invention, it is preferable that there is an appropriate length and the ratio of the length in the long-axis direction to the length in the short axis direction is 10:1 to 700:1. The specific length in the longitudinal direction of the most preferred substantially rectangular parallelepiped shape as the aroma-producing substrate to be heated is likewise preferably 10 to 70 mm.

In such an aroma-producing body to be heated having anisotropy in a cross-sectional shape perpendicular to the longitudinal direction (11 shown in FIG. 3B), the surface of the long axis direction (12 shown in FIG. 3B) in a cross-section perpendicular to the longitudinal direction is more frequently in contact with the surface of the long axis direction (12 shown in FIG. 3B) in a cross-section perpendicular to the longitudinal direction of the adjacent aroma-producing substrate to be heated than the surface of the short-axis direction (13 shown in FIG. 3B) of the cross-section perpendicular to the longitudinal direction of the adjacent aroma-producing substrate to be heated. Therefore, the filling rate can be increased while ensuring the gas flow path.

Furthermore, in such an aroma-producing body to be heated having anisotropy in a cross-sectional shape perpendicular to the longitudinal direction, the number of aroma-producing substrates to be heated where the long axis direction of the cross-section perpendicular to the longitudinal direction of the aroma-producing substrate to be heated is arranged in a tangential direction of the circumference of the aroma-producing substrate to be heated is greater than the number of heated aroma producing substrates whose long axis direction is aligned in the normal direction of the circumference of the heated aroma-producing body. Therefore, it is possible to increase the filling rate while securing the gas flow path.

Accordingly, when smoking an aroma cartridge provided with such an aroma-producing body to be heated by the heated aroma device, at the same time as performing a pleasant aerosol smoking and aroma suction, the filling rate of the aroma-producing substrate to be heated is increased, an appropriate number of inhaling is secured, and a problem of combustion of the aroma-producing substrate to be heated at the time of suction and falling off of the aroma-producing substrate to be heated at the time of attachment/detachment of the aroma cartridge can be solved. Therefore, it is easy to insert the aroma cartridge into the heating element provided in the chamber of the heated aroma device.

Then, in the aroma cartridge provided with the aroma-producing body to be heated, a member that only filter is continuously provided in a longitudinal direction with the aroma-producing body to be heated is preferably used as the mouthpiece. However, it is more preferable that the aroma cartridge include a support member capable of passing an airflow along a longitudinal direction connected to the aroma-producing body to be heated in the longitudinal direction, and a filter connected in the longitudinal direction of the support member. The support member prevents the aroma-producing body to be heated from migrating to the suction-side. The filter filters the smoke and aroma of the aerosol to prevent fallout and dust of the aroma-producing substrate to be heated from flowing into the oral cavity. Therefore, the smoker can enjoy more comfortable smoking.

Although the support member of the present invention is not particularly limited, it consists of a gas flow path and a support unit. The support member is present at least at the outermost periphery and prevents the aroma-producing body to be heated from moving toward the suction side without hindering suction, and retains t the form of the aroma cartridge. A general-purpose polymer such as a polyolefin resin such as polyethylene or polypropylene, or a polyester resin is used as for the material. On the other hand, it is possible to use a filter made of commonly used cellulose acetate fiber.

However, both the conventional support member and filter are also made from poorly biodegradable polymers. Therefore, there is a problem whereby an environmental pollutant such as microplastics is produced. Therefore, as the support member and the filter of the present invention, those made of biodegradable aliphatic polyester, and starch-based and cellulose-based biodegradable polymers are used. In particular, as the aliphatic polyester, polyethylene adipate (PEA), poly (ε-caprolactone) (PCL), poly (3-hydroxybutyrate) (PHB), poly (β-propiolactone) (PPL), poly (butylene succinate) (PBS), poly (L-lactide) (PLA), and poly (p-dioxanone) (PPDO) can be preferably used.

Despite the high filling rate of the aroma-producing substrate to be heated, the manufacturing method of the aroma-producing body to be heated plays an important role in forming the aroma-producing body to be heated having the deformed gas flow path in which the gas flow path is secured.

That is, a method for manufacturing aroma-producing body to be heated of the present invention includes: a first step of cutting a heated aroma-producing sheet containing at least an aerosol former, non-tobacco plants and/or tobacco plants, and a binding agent into a noodle-shaped aroma-producing substrate to be heated in which the cross-sectional shape cut perpendicular to the longitudinal direction is uniform in the longitudinal direction and is more than twice as long as an aroma-producing body to be heated; a second step of supporting a predetermined amount of the noodle-shaped aroma-producing substrate to be heated by a belt, and placing the noodle-shaped aroma-producing substrate to be heated on a packaging material web of an aroma-producing body to be heated having a predetermined width conveyed so that the noodle-shaped aroma-producing substrate to be heated is parallel to the longitudinal direction of the packaging material web of the aroma-producing body to be heated; a third step of rolling up the noodle-shaped aroma-producing substrate to be heated by the packaging material web of the aroma-producing body to be heated so that the noodle-shaped aroma-producing substrate to be heated is cylindrical in the longitudinal direction by bending a belt; a fourth step of linearly gluing the packaging material web of the aroma-producing body to be web of a rod-shaped aroma-producing body to be heated manufactured in the third step along the longitudinal direction; and a fifth step of cutting the rod-shaped aroma-producing body to be heated manufactured in the fourth step into predetermined lengths.

The third step of the manufacturing method of the aroma-producing body to be heated is the most important step in forming the deformed gas flow path in the aroma-producing body to be heated. In this step, the noodle-shaped aroma-producing substrate to be heated is aligned in the longitudinal direction of the aroma-producing body to be heated, placed in the longitudinal direction of the packaging material web of the aroma-producing body to be heated supported and conveyed by the belt, and the long rod-shaped aroma-producing body to be heated is formed so that the noodle-shaped aroma-producing substrate to be heated is columnar in the longitudinal direction by the packaging material web of the aroma-producing body to be heated by bending the belt, and the inner structure of the aroma-producing body to be heated is determined. The reason why the deformed gas flow path having high porosity is formed is that the primary aggregate aggregated by the movement of the noodle-shaped aroma-producing substrate to be heated forms a void by the bending of the belt, and the secondary aggregate aggregated by the movement of a noodle-shaped single body of an aroma-producing substrate to be heated or the primary aggregate thereof forms a void, and they form the deformed gas flow path that penetrates the aroma-producing body to be heated, and the single body of the noodle-shaped aroma-producing substrate to be heated, the primary aggregate and packaging material thereof form a void, and this forms the deformed gas flow path that penetrates the noodle-shaped aroma-producing body to be heated. On the other hand, the reason why the filling rate increases is that, by bending of the belt at the later period of this step, the noodle-shaped aroma-producing substrate to be heated is rounded by the packaging material from a direction perpendicular to the longitudinal direction, and the cylindrical long rod-shaped aroma-producing body to be heated is formed. Therefore, the closer the rod-shaped aroma-producing body to be heated approaches the cylindrical shape, the more the noodle-shaped aroma-producing substrate to be heated constituting the primary aggregate and the secondary aggregate of the noodle-shaped aroma-producing substrate to be heated moves while sliding, and the frequency, in which the surface of the long-axis direction in the cross-section perpendicular to the noodle-shaped aroma-producing substrate to be heated contacts with the surface of the long-axis direction in the cross-section perpendicular of the adjacent noodle-shaped aroma-producing substrate to be heated, increases, and the number of noodle-shaped aroma-producing substrates to be heated in which the long axis direction is arranged in a tangential direction of the circumference of the cylinder also increases. The filled condition of the noodle-shaped aroma-producing substrate to be heated of the outer periphery region forms a stable and strong construction. On the contrary, the center region of the rod-shaped aroma-producing body to be heated leaves bulky primary aggregates and secondary aggregates as described above. Therefore, the deformed gas flow path formed in the primary aggregate and the secondary aggregate remains, and the porosity of the center region becomes higher than that of the outer periphery region. The aroma-producing body to be heated used for the aroma cartridge is obtained by cutting a rod-shaped aroma-producing body to be heated in which the inner structure is formed in this manner. The aroma-producing body to be heated has exactly the same inner structure as this inner structure.

That is, the noodle-shaped aroma-producing substrate to be heated, which is longer than the length in the longitudinal direction of the aroma-producing body to be heated and has substantially the same cross-sectional shape, is placed in the longitudinal direction of the packaging material web of the aroma-producing body to be heated, which is a roll shape, and is rounded to have a columnar shape in the longitudinal direction. For this reason, the deformed gas flow path of the rod-shaped aroma-producing body to be heated becomes a through hole, and in the rounding process, as the noodle-shaped aroma-producing substrate to be heated forms a cylinder, the primary aggregate and the secondary aggregate are formed, the deformed gas flow paths are formed in themselves, and the deformed gas flow path can also be formed between the rod-shaped aroma-producing body to be heated and the packaging material. In this process, the primary aggregate and secondary aggregate remain at the center region of the cylindrical rod-shaped aroma-producing substrate to be heated. However, in the outer periphery region, the frequency of contact of the long axis direction in the perpendicular cross-section of the noodle-shaped aroma-producing substrate to be heated with the long axis direction in the perpendicular cross-section of the neighboring noodle-shaped aroma-producing substrate to be heated increases, and the ratio of arrangement in the tangential direction of the circumference of the cylinder increases, and the filling rate increases.

In order to control such behavior, the shape of the noodle-shaped aroma-producing substrate to be heated is important, and it is preferable that the noodle-shaped aroma-producing substrate to be heated to be cut in the first step has an aspect ratio of the length of the long axis and the length of the short axis of the cross-section perpendicular to the longitudinal direction of 1:1 to 30:1, and an aspect ratio of the length of the longitudinal direction and the length of the short axis of 40:1 to 3600:1. In particular, the aspect ratio of the length of the long axis to the length of the short axis is more preferably 2:1 to 20:1, and more preferably 5:1 to 20:1. These aspect ratios are closely related to mobility when the noodle-shaped aroma-producing substrate to be heated arranged in the longitudinal direction is formed into a columnar shape so as to be wrapped from the longitudinal direction and the perpendicular direction, and the filling rate can be increased while securing the gas flow path. Therefore, when the aspect ratio of the lengths of the long axis and the lengths of the short axis in the cross-section perpendicular to the longitudinal direction exceeds 30:1, and the aspect ratio of the lengths of the longitudinal direction and the lengths of the short axis exceeds 3600:1, the frequency in which the noodle-shaped aroma-producing body to be heated comes into contact with the surface of the long axis direction increases, mobility is extremely reduced, and it is difficult to form the primary aggregate and the secondary aggregate. In the case where the aspect ratio of the length of the long axis to the length of the short axis is 1:1, the noodle-shaped aroma-producing body to be heated may be arranged similar to a close-packed structure depending on manufacturing conditions.

The shape of the cross-section perpendicular to the longitudinal direction in the noodle-shaped aroma-producing substrate to be heated can be an isotropic triangle, a square, a regular polygon such as a regular pentagon, and a circle. However, it is more preferable that the shape of the cross-section be rectangular and elliptical having a short axis and a long axis, and it is furthermore preferable that the cross-section be substantially rectangular in order to form an anisotropic gas flow path.

It is clear from the above that the third step of rounding the noodle-shaped aroma-producing substrate to be heated of the present invention into a cylinder in the longitudinal direction is characterized in making a guide provided with a groove capable of gradually bending the belt in a cylindrical shape, together with the belt, pass through the noodle-shaped aroma-producing substrate to be heated which is supported and transported to the belt and on the packaging material. This belt may also utilize a stringer tape, such as that described in, for example, Japanese laid-open patent publication No. 2005-232619, which is used in cigarette tobacco.

As is apparent from the above, in a cross-section perpendicular to the longitudinal direction of the rod-shaped aroma-producing body to be heated, when the center region and the outer peripheral region are equally divided by area, it is possible to increase the porosity of the center region than that of the outer peripheral region. Thus, this state is reflected as it is in the aroma-producing body to be heated provided in the aroma cartridge.

This is a closely related to the fact that in the process of winding up the noodle-shaped aroma-producing substrate to be heated having anisotropy in the cross-sectional shape perpendicular to the longitudinal direction by the packaging material, and forming the primary aggregate and the secondary aggregate, the surface in the long-axis direction in the cross-section perpendicular to the longitudinal direction of the noodle-shaped aroma-producing substrate to be heated has a higher frequency of contact with the surface of the long-axis direction in the cross-section perpendicular to the longitudinal direction of the adjacent noodle-shaped aroma-producing substrate to be heated than the surface of the short-axis direction in the cross-section perpendicular to the longitudinal direction of the adjacent noodle-shaped aroma-producing substrate to be heated. Further, in this process, there is a close relation in the fact that the number of noodle-shaped aroma-producing substrates to be heated in which the long axis direction in the cross-section perpendicular to the longitudinal direction in the noodle-shaped aroma-producing substrate to be heated is arranged in the tangential direction of the circumference in the rod-shaped aroma-producing body to be heated can be made larger than the number of noodle-shaped aroma-producing substrates to be heated in which the long axis direction is arranged in the normal direction of the circumference in the rod-shaped aroma-producing body to be heated.

As described above, the shape of the noodle-shaped aroma-producing substrate to be heated has a large influence on the structure of the cross-section perpendicular to the longitudinal direction of the rod-shaped aroma-producing body to be heated. However, it is possible to control the structure of the cross-section perpendicular to the length direction of the rod-shaped aroma-producing body to be heated by the conveyance speed of the belt, and the shape of the guide, and the like.

Further, in order to easily perform line bonding in the longitudinal direction of the heated aroma-producing package material, it is preferable to add a step of applying a predetermined amount of hot melt adhesive to a predetermined position of the heated aroma-producing package material web in parallel with the first step, and to provide a heating means in the fourth step.

Then, the manufacturing method of the above-mentioned aroma-producing body to be heated can be continuously manufactured by the following device. In other words, the manufacturing device of the aroma-producing body to be heated of the present invention includes a feeding device for a noodle-shaped aroma-producing substrate cut from a heated aroma-producing sheet containing at least an aerosol former, non-tobacco plants and/or tobacco plants, and a binding agent; a feeding device for a packaging material web of the aroma-producing body to be heated; an endless belt drive system supporting and transporting the packaging material web of the aroma-producing body to be heated; a guide including a plurality of grooves provided in a transport path of the endless belt; an adhesion device for the packaging material web of the aroma-producing body to be heated; and a cutting machine for a rod-shaped aroma-producing body to be heated, the rod-shaped aroma-producing body to be heated manufactured by winding up the aroma-producing substrate to be heated with the packaging material web of the aroma-producing body to be heated, all being continuously driven. Here, it is preferable to have three or four different guides so that the grooves of the plurality of guides are cylindrical in stages, from a groove about the shape of a crescent moon, through to a groove about the shape of a half moon, to a groove close to an abbreviated full moon.

The manufacturing device for the aroma-producing body to be heated of the present invention simplifies the bonding process of the packaging material of the aroma-producing body to be heated, and it is preferable that the manufacturing device of the aroma-producing body to be heated includes a feeding device for a noodle-shaped aroma-producing substrate cut from a heated aroma-producing sheet containing at least an aerosol former, non-tobacco plants and/or tobacco plants, and a binding agent; a feeding device for a packaging material web of the aroma-producing body to be heated; an endless belt drive system supporting and transporting the packaging material web of the aroma-producing body to be heated; a guide including a plurality of grooves provided in a transport path of the endless belt; an adhesion device for the packaging material web of the aroma-producing body to be heated; and a cutting machine for a rod-shaped aroma-producing body to be heated, the rod-shaped aroma-producing body to be heated manufactured by winding up the aroma-producing substrate to be heated with the packaging material web of the aroma-producing body to be heated, all being continuously driven.

According to the present invention, in a cross-section perpendicular to the longitudinal direction of the aroma-producing body to be heated, the primary aggregate and the secondary aggregate of the aroma-producing substrate to be heated are generated, while it is possible to increase the filling rate of the aroma-producing substrate to be heated, the deformed gas flow path is formed inside the primary aggregate and the secondary aggregate, the deformed gas flow path is formed between the packaging material of the aroma-producing body to be heated and the aroma-producing substrate to be heated and the primary aggregate, and the smoke and fragrance of the aerosol can be sufficiently inhaled into the mouth of the smoker since these deformed gas flow paths penetrate the aroma-producing body to be heated.

Further, since the aroma-producing body to be heated of the present invention has a high filling rate and the filling rate of the aroma-producing substrate to be heated at the outer periphery region is higher than the center region, the aroma-producing substrate to be heated forms a strong structure against pressure from the end part and the outer periphery of the aroma-producing body to be heated, so that the aroma-producing substrate to be heated does not fall off when the aroma cartridge is attached/detached, an appropriate number of inhaling per one piece of tobacco is secured, and problems of burning of the aroma-producing substrate to be heated at the time of inhaling do not occur. In addition, the lower fill rate of the center region facilitates insertion of the aroma cartridge into the heating element of the heated aroma device.

On the other hand, according to the manufacturing method and the manufacturing device of the aroma-producing body to be heated of the present invention, it is possible to stably and continuously produce an aroma-producing body to be heated having a deformed gas flow path with a high filling rate and secured porosity.

BRIEF DESCRIPTION OF DRAWINGS

FIG. 3A is an example of a substantially square cross-section, and FIG. 3B is an example of a substantially rectangular cross-section.

FIG. 4A is an example in which the cross-section is substantially circular, and FIG. 4B is an example in which the cross-section is substantially elliptical.

DESCRIPTION OF EMBODIMENT

In the following description, the present invention will be described in more detail using one embodiment, but the present invention is not limited thereto, and various modifications may be made within a scope which does not depart from the gist of the present invention, and the present invention is limited only by the technical idea described in the claims.

Figure 1:
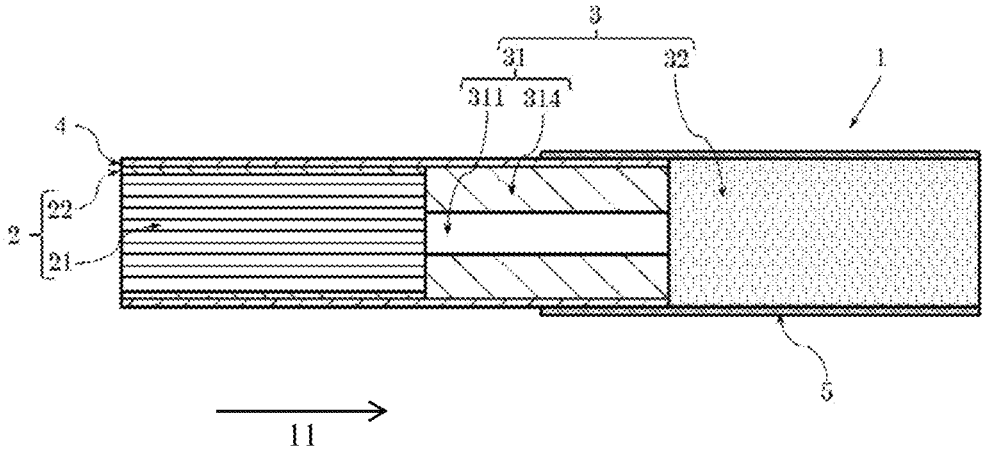
FIG. 1 is a schematic cross-sectional view of an aroma cartridge of an embodiment of the present invention which is provided with an aroma-producing body to be heated having a deformed gas flow path, the cartridge being cut in the longitudinal direction through the central axis.

FIG. 1 is a schematic cross-sectional view of an aroma cartridge 1 provided with an aroma-producing body to be heated 2 having a deformed gas flow path (233, 235 and 241 shown in FIG. 7), the cartridge 1 being cut in the longitudinal direction 11 through the central axis. In the aroma cartridge 1, the aroma-producing body to be heated 2 and a mouthpiece 3 composed of a support member 31 and a filter 32 are connected in the longitudinal direction 11. The aroma-producing body to be heated 2 is formed into a substantially cylindrical shape by bundling an aroma-producing substrate to be heated 21 with a packaging material of the aroma-producing body to be heated 22. The support member 31 has a gas flow path (1) 311 and a support unit (1) 314. In FIG. 1, the aroma-producing body to be heated 2 and the support member 31 are connected in the longitudinal direction by an aroma-producing body to be heated/support member connection member 4. Further, the cylindrical filter 32, which is a spongy porous material, is integrated as the aroma cartridge 1 in the longitudinal direction of the support member 31 by an aroma cartridge exterior member 5, but the present invention is not limited thereto.

The aroma-producing substrate to be heated 21 includes at least an aerosol former, a tobacco plant and/or a non-tobacco plant, and a bonding agent, but details thereof will be described later.

Those produced using PLA, which is a biodegradable plastic, are used as a raw material for the support member 31 and the filter 32 so that the aroma cartridge 1 does not become an environmental pollutant.

The aroma cartridge 1 of FIG. 1 is molded to have a maximum outer diameter of 6.5 to 7.5 mm and a length of 40 to 49 mm. The length of the aroma-producing body to be heated 2 is cut to 11 to 13 mm. However, since these dimensions are determined depending on the chamber of the heated aroma device, they are not limited thereto.

Figure 2:
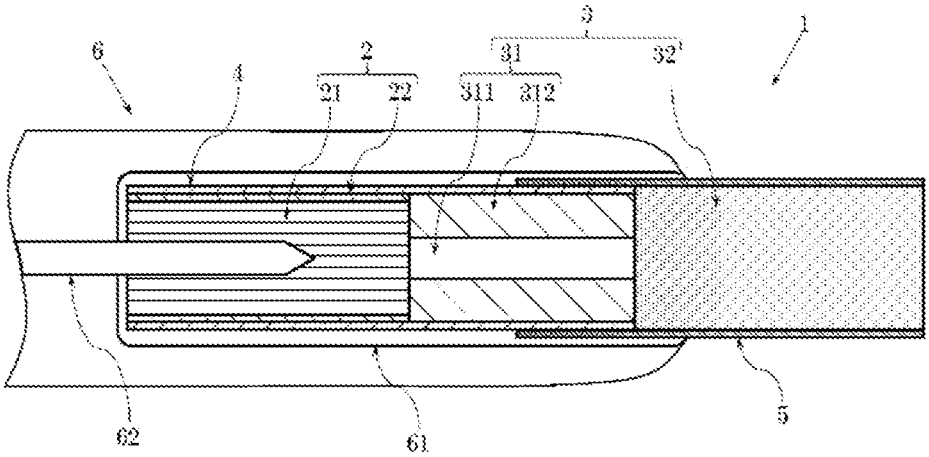
FIG. 2 is a schematic cross-sectional view of the aroma cartridge shown in FIG. 1 and a heated aroma device cut through the central axis in the longitudinal direction, wherein the aroma cartridge is inserted into a heated aroma device with an electrically controlled heating element in the chamber.

FIG. 2 is a cross-sectional view showing the usage pattern of the aroma cartridge 1. FIG. 2 is a schematic cross-sectional view of the aroma cartridge 1 shown in FIG. 1 and a heated aroma device 6, which are cut longitudinally through the central axis. The heated aroma device 6 includes an electrically controlled heating element 62 in a chamber 61. The aroma cartridge 1 is inserted into the heated aroma device 6. The aroma cartridge 1 is inserted into the chamber 61 of the heated aroma device 6. The aroma-producing body to be heated 2 is inserted into a needle-shaped or blade-shaped electrically controlled heating element 62 in the chamber 61. The aroma-producing substrate to be heated 21 and the heating element 62 are in contact with each other. When the heating element 62 is temperature-controlled at 200 to 350° C. by an electric control unit (not shown), the aerosol former and an aroma component are volatilized from the aroma-producing substrate to be heated 21. When a smoker inhales from the mouthpiece 3 in this state, the smoke and the aroma component of the aerosol generated by cooling the aerosol former can be inhaled, and the smoker can enjoy the smoke.

Hereinafter, it is necessary to be described the aroma-producing substrate to be heated 21 constituting the aroma-producing body to be heated 2 shown in FIGS. 1 and 2 and a noodle-shaped aroma-producing substrate to be heated 23 serving as a raw material for producing the same separately below. However, since the aroma-producing substrate to be heated 21 is only obtained by cutting the noodle-shaped aroma-producing substrate to be heated 23 and is the same chemical composition as the noodle-shaped aroma-producing substrate to be heated 23. When referring to both, it is simply referred to as the aroma-producing substrate to be heated.

The aroma-producing substrate to be heated is formed by at least mixing an aerosol former such as glycerin or propylene glycol which produces an aerosol, a dried and pulverized tobacco plant and/or a non-tobacco plant, and a bonding agent, forming the mixture into a sheet, and then cutting the mixture into a predetermined dimension. As a specific composition of the aroma-producing substrate to be heated, it is preferable to add a B-cyclodextrin, a flavoring agent, and an antibacterial preservative, and the like, as appropriate, in addition to microcrystalline cellulose which also acts as the bonding agent, the crosslinked polyvinylpyrrolidone, and a thickener.

The microcrystalline cellulose has an effect of preventing adhesion with a molding machine and maintaining the shape when performing molding in a sheet. Cross-linked polyvinylpyrrolidone can maintain morphology along with the effect of retaining aroma components. B-cyclodextrin has an effect of retaining an aroma component having a phenolic hydroxyl group such as menthol. The thickener has the function of adjusting the composition to an appropriate viscosity when molding into a sheet. In the case where the aroma component is not sufficient with a tobacco plant and/or a non-tobacco plant alone, it may be preferable to add a flavoring agent. Since plants are sometimes used for the antibacterial preservative, it is necessary to ensure the expiration date.

In this embodiment, the plant forming the aroma-producing substrate to be heated is limited to a non-tobacco plant.

However, there is no particular limitation as long as it is a plant other than a tobacco plant. For example, various plant sites such as roots (tuberous roots (including potatoes, etc.), rhizophore, etc.), underground stems (bulbs, corms, tubers, rhizomes, etc.), stems, barks (including stem barks, barks, etc.), leaves, flowers (including petals, stamens, pistils, etc.), trunks and branches of trees, etc. can be used.

Tuberous roots include dahlia, sweet potato, cassava, Jerusalem artichoke, and rhizophore includes *Dioscorea* (Yams such as yams, natural yams, and *Dioscorea polystachya*), bulbs include onions, *Lycoris radiata*, tulips, hyacinths, garlic, *Allium* Chinese, lilies, corms include *crocus, gladiolus*, freesia, *Iris sanguinea, Colocasia esculenta*, konjac, tubers include konjac, cyclamen, anemone, *begonia*, Stachys affnis Bunge, potatoes, apioses, rhizomes include *canna*, lotus, gingers, and other includes turnips, burdocks, carrots, Japanese radishes, kudzu, and the like. Stems include asparagus, bamboo shoots, *udo*, Japanese radishes, and yacons.

The above-mentioned potatoes or plants mentioned below contain carbohydrates and are preferably used as a material for at least a part of a non-tobacco plant. For example, starch may be cornstarch (corn), dogtooth violet starch (potato), sweet potato starch (sweet potato), tapioca starch (tapioca), or the like, and may be used as a thickener, a stabilizer, or the like. These starches are capable of improving the acid resistance, improving the heat resistance, improving the share resistance, and the like by crosslinking, esterifying, etherifying, improving the storage stability, promoting gelatinization, and the like, and improving the transparency, improving the film property, improving the storage stability, and the like by oxidation.

Tamarind seed gum, guar gum, and locust bean gum, obtained from plant seeds, gum arabic, and karaya gum, obtained from sap, pectin, obtained from fruits, cellulose, obtained from other plants, konjac mannan containing agarose as a main component, soy polysaccharide can be utilized. In addition, some can be used in a modified form, such as a cationized guar gum.

Carrageenan (classified into 3 types: kappa carrageenan, iota carrageenan, lambda carrageenan), agar, and alginic acid, which is obtained from seaweed, can be utilized, and is also used as a salt such as carrageenan metal salt and Na alginate.

Plants used as herbs and spices include *gardenia* fruit, kaffir lime leaves, Japanese ginger, wormwood, wasabi, ajowan seeds, anise, alfalfa, *echinacea*, shallot, estragon, everlating flower, elder, all spice, orris root, oregano, orange peel, orange flower, orange leaf, cayenne chili pepper, German chamomile, chamomile roman, cardamom, curry leaf, garlic, catnip, caraway, caraway seed, Osmanthus *fragrans*, cumin, cumin seed, clove, green cardamom, green pepper, corn flower, saffron, cedar, cinnamon, jasmine, juniper berry, jolokia, ginger, star anis, spearmint, smack, sage, savory, celery, celery seed, turmeric, thyme, tamarind, tarragon, chervil, chive, dill, dill seed, tomato (dried tomato), tonka bean, dried coriander, nutmeg, hibiscus, habanero, jalapeno, birds eye, basil, vanilla, coriander, parsley, paprika, hysop, Piment d'espelette, pink pepper, fenugreek seed, fennel, brown mustard, black cardamom, black pepper, vetiver, pennyroyal, peppermint, horseradish, white pepper, white mustard, poppy seed, porcini, marjoram, mustard seed, Manigetto, marigold, malva *sylvestris*, Mace, yarrow flower, *eucalyptus*, lavender, licorice, lindane, red clover, red pepper, lemongrass, lemon *verbena*, lemon balm, lemon peel, rose, rose bud (purple), rose hip, rose pedal, rosemary, rose red, laurel (bay leaf), long pepper, sesame (raw sesame, roasted sesame), golden pepper, Chinese pepper (hoajaoen), Mitaka, pepper, cayenne pepper, yuzu, and the like. Mixtures of various plants used as mixed spice (e.g., five-spice powder, garam masala, Ras El Hanout, barigoule, chicken curry masala, tandoori masala, Quatre epices, Herbes de Provence), pot-pourri, and the like can also be used.

Edible fruits (flesh parts) and seeds such as peaches, blueberries, lemons, oranges, apples, bananas, pineapples, mangoes, grapes, kumquats, melons, plums, almonds, cacaos, coffee, peanuts, sunflowers, olives, walnuts, and other nuts may also be used.

In addition, teas can be used. Teas are not only different from each other in the plant which becomes tea, but also different from each other in the same plant by the processing method, so that any tea can be used. Specifically, Japanese tea, black tea, *Angelica keiskei* tea, *Hydrangea macrophylla* tea, *Gynostemma pentaphyllum* tea, aloe tea, ginkgo leaf tea, oolong tea, turmeric tea, *Quercus salicina* Blume tea, *Eleutherococcus senticosus* tea, *Plantago asiatica* tea, *Glechoma hederacea* tea, persimmon leaf tea, chamomile tea, Kawara Ketsumei tea, Chinese quince tea, *chrysanthemum* flower tea, gymnema tea, guava tea, Chinese wolfberry fruit tea, mulberry leaf tea, black soybean tea, *Geranium thunbergii* tea, brown rice tea, burdock tea, comfrey tea, seaweed tea, sakura tea, saffron tea, Shiitake tea, *perilla* tea, Jasmine tea, ginger tea, Equisetum *arvense* tea, *Acorus gramineus* tea, Swertia *japonica* tea, *Fagopyrum esculentum* tea, *Aralia elata* tea, dandelion tea, ten-cha, Houttuynia *cordata* tea, Eucommia ulmoides tea, sword bean tea, Japanese red elder tea, *Ligustrum japonicum* tea, adlay tea, *senna* tea, loquat leaf tea, pu'er tea, safflower tea, *pinus* tea, mate, barley tea, Nikko maple tea, mugwort tea, *eucalyptus* tea, Siraitia grosvenorii tea, rooibos tea, goya-cha, and the like are examples. Tea leaves after drinking may be used for these teas. If tea leaves or the like are used, there is an advantage that an expensive tea or the like can be reused and effectively used.

Other non-tobacco plants which can be used may include sea lettuce, green laver, Sargassum horneri, Asakusa nori, Eisenia bicyclis, duckweeds, squashes, araches, rock seaweed (iwanori), Campylaephora hypnaeoides, Gracilaria vermiculophylla, *Saccharina* sculpera, Ecklonia cava, Ganiashi, *Caulerpa* lentillifera, Ecklonia kurome, Laminariaceae, Neopyropia *yezoensis, Palmaria palmata*, Pyropia kurogii, Ecklonia *stolonifera*, Gelidiaceae, *Saccharina* gyrate, *Arthrothamnus* Ruprecht, laver, Petalonia *binghamiae*, Sargassum *fusiforme, Monostroma nitidum*, Undaria undarioides, Gloiopeltis, *Ulva intestinalis, Saccharina japonica*, root of the wakame seaweed, Nemacystus *decipiens*, and *Undaria pinnatifida*.

Grass plants including rice of Indica species (Indian type, continental type, long grain type), *glaberrima* species (African rice), *sativa* species (Asian type), *javanica* species (Java type, tropical island type, large grain type), *japonica* species (Japanese type, temperate island type, short grain type), NERICA species (interspecies hybrid of Asian and African rice), and rice can also be used as flour or bran.

Other grass plants may include millets, oat, barley, common wild oat, Proso millet, *Paspalum scrobiculatum* L., wheat, finger millet, teff, pearl millet, naked barley (varieties of barley), adlay (fruits rather than seeds), Japanese barnyard millet, fonio, Manchurian Wild Rice, mochi wheat (mochi type of barley), corn, rye.

Leguminous plants include black soybeans, azuki bean, carob, common bean, pea, black gram, cowpea, winged bean, *Macrotyloma geocarpum*, broad bean, soybean, rice-bean, Jack-bean, tamarind, tepary bean, sword bean,

*Mucuna pruriens, Vigna* subterranean, chickpea, hyacinth beans, runner beans, horse gram, moth beans, lima beans, peanuts, mung beans, lupins, lentil, and lentil (almond).

Buckwheat, amaranth (*amaranthus*, senninkoku), quinua, and tartary buckwheat can also be used.

Examples of mushrooms include shiitake, matsutake, hatsutake, shimeji, shoro, mushrooms, and field mushrooms.

Trunks and branches of trees with an aroma such as sugar cane (which may be molasses pomace), sugar beet, cypress, pine, cedar, hiba, tsubaki, sandalwood, and these barks, leaves, roots, and the like can also be used. It is also possible to use ferns, mosses, and the like as a non-tobacco plant.

By-products and pomace from the production of fermented sake such as sake and wine (sake lees, grape pomace (consisting of grape skins, seeds, fruit stems, etc.)) and the like can also be used as the non-tobacco plant. In addition, various plants described above may be mixed and used, or non-tobacco plants other than those described above may be used.

Those known as crude drugs are also preferably used. Specifically, crude drugs include *Persicaria tinctoria* (Aiso), Indian Madder Root (Akanekon), Mallotus Bark (Akamegashiwa), Gambir (Asenyaku), *Styrax benzoin* (Ansokuko), *Clematis* root (Ireisen), *Artemisia Capillaris* Flower (Inchinko), Fennel (Uikyo), Turmeric (Ukon), Processed Mume (Ubai), *Lindera* Root (Uyaku), *Quercus* Salicina Folium (Urazirogashi), Cowberyy (Uva-*ursi*), Rose Fruit (Eijitsu), Corydalis Tuber (Engosaku), Isodon Herb (Enmeisou), *Astragalus* Root (Ogi), Scutellaria Root (Ogon), *Polygonatum* Rhizome (Osei), Phellodendron Bark (Obaku), Coptis Rhizome (Oren), Cherry Bark (Ohi), Hyperici Erecti Herba (Otogirisou), Polygala Root (Onji), *Sophora Japonica* Flower (Kaika), *Allii Chinense* Bulbus (Gaihaku), Prunella Spike (Kagosou), Myrobalan Fruit (Kashi), *Polygonum* Root (Kashu), *Curcuma* Rhizome (Gajutsu), Patchouli (Kakko), *Pueraria* Root (Kakkon), German Chamomile Flower (Kamitsure), *Trichosanthes* Root (Karokon), *Trichosanthes* Seed (Karonin), Processed Ginger (Kankyo), *Glycyrrhiza* (Kanzo), Common Coltsfoot Flower (Kantoka), *Artemisia* Leaf (Gaiyo), Platycodon Root (Kikyo), Hoveniae Semen Seu Fructus (Kigushi), Orange Fruit (Kikoku), Immature Orange Fruit (Kijitsu), *Chrysanthemum* Flower (Kikuka), Citrus Peel (Kippi), *Notopterygium* (Kyokatsu), Apricot Kernel (Kyonin), Kumquat (Kinkan), *Lonicera* Flower (Kinginka), Snowbellleaf Tickclover Herb (Kinginso), *Lycium* Fruit (Kukoshi), *Lycium* Leaf (Kukoyo), *Sophora* Root (Kujin), Walnut (Kurumi), Szechwan Chinaberry Bark (Kurempi), *Lindera* umbellate (Kuromoji), Lilac Pink Herb (Kubaku), Schizonepeta Spike (Keigai), Cinnamon Bark (Keihi), *Cassia* Seed (Ketsumeishi), *Pharbitis* Seed (Kengoshi), Scrophularia Root (Genjin), Koi, Safflower (Koka), Silktree *Albizia* Bark (Gokanhi), *Dalbergia Odorifera* (Koko), Fermented Soybean (Koshi), Chinese Mosla (Koju), Red *Ginseng* (Kojin), *Cyperus* Rhizome (Kobushi), Brown Rice (Kobei), *Magnolia* Bark (Koboku), Kohon, Acanthopanacis Cortex (Gokahi), Two-toothed Achyranthes Root (Goshitsu), Euodia Fruit (Goshutsu), Japanese knotweed (Goshokon), Burdock Fruit (Goboshi), Schisandra Fruit (Gomishi), Bupleurum Root (Saiko), Asiasarum Root (Saishin), Saffron, *Smilax* Rhizome (Sankirai), *Crataegus* Fruit (Sanzashi), *Gardenia* Fruit (Sanshishi), *Cornus* Fruit (Sanshuyu), *Sophora* Subprostrata Root (Sanzukon), Jujube Seed (Sanso-nin), Japanese Zanthoxylum Peel (Sansho), Sanryo, *Dioscorea* Rhizome (Sanyaku), Rehmannia Root (Jio), Tatarian aster (Shion), *Lycium* Bark (Jikoppi), *Perilla* Root (shikon), *Perilla* Fruit, *Perilla* Herb, Tribulus Fruit (shitsurishi), shitei, Belvedere Fruit (Jifushi), Peony Root (Shakuyaku), Cnidium Monnieri Fruit (Jashoshi), Codonopsis Root (Shajin), *Plantago* Seed (Shazenshi), *Plantago* Herb (Shazenso), Amomum Seed (Shukusha), Houttuynia Herb (Juyaku), ginger (Shokyo), palm fruit (Shurojitsu), Palm leaf (Shuroyo), Cimicifuga Rhizome (Shoma), Wheat (Shobaku), Sweet Flag Root (Shobukon), *Magnolia* Flower (*Shini*), *Ligustrum* Fruit (Joteishi), Japanese Ash (Shimpi), Malted Rice (Shinkiku), *Gentiana Macrophylla* (Jingyo), Motherwort Fruit (Juishi), Sichuan Pepper (Shokumoku), Immature Citrus Unshiu Peel (Seihi), *Acorus* Gramineus Rhizome (Sekishokon), Pomegranate Rind (Sekiryujitsuhi), Dendrobium *Moniliforme* (Sekkoku), Cnidium Rhizome (Senkyu), *Peucedanum* Root (Zenko), *Nuphar* Rhizome (Semkotsu), Inula Flower (Sempukuka), *Sambuci* Lignum (Sekkotsuboku), Caoguo (Soka), Chinise Honeylocust Spine (Sokakushi), Colored Mistletoe Herb (Sokisei), Siberian Cocklebur Fruit (Sojishi), Atractylodes Lancea Rhizome (Sojutsu), Chinese Arborvitae Twig and Leaf (Sohakuyo), Himalayan Teasel Root (Zokudan), Mulberry Bark (Sohakuhi), *Sappan* Wood (Soboku), *Perilla* Herb (Soyo), Chinise Honeylocust Abnormal Fruit (Sokyo), Rhubarb (Daio), Jujube (Taiso), *Areca* Pericarp (Daifukuhi), Arrowhead (Takusha), Danshen Root (Tanjin), Bamboo Culm (Chikujo), *Panax Japonicus* Rhizome (Chikusetsuninjin), Bamboo Leaf (Chikuyo), Anemarrhena Rhizome (Chimo), Garden Burnet Root (Chiyu), Clove (Choji), Uncaria Hook (Chotoko), Citrus Unshiu Peel (Chimpi), *Arisaema* Tuber (Tennansho), *Gastrodia* Tuber (Tenma), Asparagus Root (Tenmondo), Benincasa Seed (Togashi), Japanese *Angelica* Root (Toki), Castor Seed (Togoma), Codonopsis Root (Tojin), Juncus Effusus (Toshinso), Peach Kernel (Tonin), Bitter Orange Peel (Tohi), Dodder Seed (Toshishi), Conker (Tochinomi), Eucommia Bark (Tochu), Oudo (Dokkatsu), Cucumeroides (Dokakon), Cistanche Herb *Trichosanthes* (Nikujuyo), Nutmeg (Nikuzuku), *Lonicera* Leaf and Stem (Nindo), *Ginseng* (Ninjin), *Fritillaria* Bulb (Baimo), Malt (Bakuga), Chinese Arborvitae Kernel (Hakushinin), Dolichi Semen (Hakuhenzu), Ophiopogon Tuber (Bakumonto), Malaytea Scurfpea Fruit (Hakoshi), Mentha Herb (Hakka), Banka, Pinellia Tuber (Hange), *Agkistrodon* (Hambi), Isatis Root (Banlankon), Barbated Skullcup Herb (Hanshiren), *Lilium* Bulb (Yurine), *Angelica Dahurica* Root (Byakushi), *Hedyotis Diffusa* (Byakukajazetsuso), Stemona *Japonica* (Byakubukon), Atractylodes Rhizome (Byakujutsu), *Areca* (Buinroji), Sinomenium Stem and Rhizome (Boi), *Imperata* Rhizome (Bokon), Saposhnikovia Root and Rhizome (Bofu), Cattail Pollen (Hoo), Dandelion (Hoeikon), Moutan Bark (Botanpi), Ephedra Herb (Mao), Hemp Fruit (Manishin), Vitex *Rotundifolia* (Mankeishi), Rosin (Matsuyani), Mokutsu, *Chaenomeles* Fruit (Mokka), Saussurea Root (Mokko), Myrrh (Motsuyaku), Common Scouring Rush Herb (Mokuzoku), Leopard Flower (Yakan), Bitter Cardamom (Yakuchi), *Reynoutria multiflora* (Yakoto), Grosvenor *Momordica* Fruit (Rakanka), Fortune Eupatorium Herb (Ranso), Longan Aril (Ryuganniku), Japanese Gentian (Ryutan), Alpinia *Officinarum* Rhizome (Ryokyu), Glossy *Ganoderma* (Reshi), Forsythia Fruit (Rengyo), *Nelumbo* Seed (Renniku), Reed Rhizome (Rokon).

An extract of a non-tobacco plant, "so-called extracts", can also be used, and examples of the form of the extract include a liquid, a water comb, a powder, a granule, and a solution, and the like.

Next, glycerin, propylene glycol, sorbitol, triethylene glycol, lactic acid, diacetin (glycerin diacetate), triacetin (glycerin triacetate), triethylene glycol diacetate, triethyl citrate, isopropyl myristate, methyl stearate, dimethyl dodecanedioate, dimethyl tetradecanesanedionate, and the like can be used as the aerosol former. Glycerin and propylene glycol are particularly preferred. Such an aerosol former is preferably used in an amount of 1 to 80% by mass, more preferably 10 to 40% by mass, based on the aroma-producing substrate to be heated.

If necessary, a flavoring agent is preferably used to add flavor. Examples of the flavoring agent include peppermint, cocoa, coffee, extract of black tea, and the like.

It is preferable to add an antibacterial preservative of food to enhance stability, and sorbic acid, potassium sorbate, benzoic acid, sodium benzoate, and the like can be used for the antibacterial preservative.

Polysaccharides such as guar gum, xanthan gum, gum arabic, locust bean gum, carrageenan, agar, alginic acid, and pectin, cellulosic polysaccharides such as hydroxypropylcellulose, carboxymethylcellulose, hydroxyethylcellulose, methylcellulose, and ethylcellulose, starch-based polysaccharides such as starch and dextrin, and organic acid salts such as alginic acid, carboxymethylcellulose, and pectin may be used alone or in combination of two or more thereof as a bonding agent and/or a thickener.

Microcrystalline cellulose is a highly pure, flowable crystallized cellulose powder obtained by hydrolyzing and purifying pulp with an acid, which is not dissolved in an organic solvent such as water or ethanol and is used as an excipient for tablet molding of a medicine. This is because, it is effective in preventing aggregation fracture, and preventing adhesion to a mold, and the like in molding a tablet by a direct tableting method due to having a large fluidity and high compressibility with a large volume change of microcrystalline cellulose. Also in the present invention, for example, an effect of effectively preventing aggregation fracture of the sheet and adhesion to the metal roll was observed in sheet production for producing an aroma-producing substrate to be heated by roll molding of three rolls by adding microcrystalline cellulose.

The microcrystalline cellulose can be introduced even as a powder or as a suspension by being dispersed in a solvent such as water. When dispersing in a solvent, it is preferable to use a high-speed stirrer, a high-pressure homogenizer, or the like. The amount of the microcrystalline cellulose to be added is preferably 1 to 15% by mass, more preferably 3 to 12% by mass, and still more preferably 5 to 10% by mass, of the aroma-producing substrate to be heated.

The average particle size of the microcrystalline cellulose used in the present invention is preferably 30 to 200 μm, more preferably 50 to 150 μm, and still more preferably 70 to 120 μm. When the average particle diameter of the microcrystalline cellulose is 30 μm or more, the effect of preventing aggregation fracture of the sheet is excellent, and when it is 200 μm or less, adhesion of the sheet and the metal roll can be effectively prevented.

The average particle diameter of the above microcrystalline cellulose is a value determined by a sieving method according to the method described in JIS K 0069:1992. In other words, the above average particle diameter refers to a diameter corresponding to a mass of 50% by integrating a mass from a larger opening with respect to a test result by a plurality of sieves. In this case, it is more preferable that the average particle diameter is such that a residue on a sieve having an opening of 250 μm is 8% by mass or less, and a residue on a sieve having an opening of 75 μm is 45% by mass or more. In the case where the residue on the sieve having an opening of 250 μm is 8% by mass or less, the sieved microcrystalline cellulose has an effect of preventing aggregation fracture of the sheet. In the case where the residue on the sieve having an opening of 75 μm is 45% by mass or more, adhesion between the sheet and the metal roll can be prevented.

The mass average molecular weight (Mw) of the microcrystalline cellulose is preferably 10,000 to 200, 000, more preferably 10,000 to 100,000, and still more preferably 20,000 to 60,000. When the amount is 10,000 or more, the effect of suppressing aggregation fracture of the sheet is excellent. When the amount is 100,000 or less, in addition to the effect of suppressing aggregation fracture of the sheet, adhesion of the sheet and the metal roll can be effectively prevented.

The molecular weight of cellulose can be measured by gel permeation chromatography (GPC). For example, a measurement method as disclosed in Japanese laid-open patent publication No. 6-109715 is employed. Polyethylene glycol or the like is used as a standard sample as appropriate.

Next, a manufacturing process of the noodle-shaped aroma-producing substrate to be heated 23 serving as a raw material for producing the aroma-producing body to be heated will be described. The noodle-shaped aroma-producing substrate to be heated 23 is manufactured through a drying and pulverizing step of drying and pulverizing a non-tobacco plant serving as the main raw material and performing weighing and the like, a preparation step of performing pretreatment, weighing, and the like of other raw materials, a mixing step of mixing the raw materials into a composition, a molding step of molding the composition into a heated aroma-producing sheet, and a cutting step of cutting the sheet into the noodle-shaped aroma-producing substrate to be heated 23.

In the drying and pulverizing step, since the use site of the non-tobacco plant serving as the main raw material (e.g., leaves, seeds, dried fruits, stems, bark, roots, and the like) is used as the composition, it is heated and dried and processed into a pulverized product of a predetermined size. In this case, the pulverized product is adjusted to a moisture content suitable for slurring (dispersing, absorbing, and distilling) the aerosol former, water, and other components to be added later. Therefore, drying is preferably performed at a temperature of 60 to 80° C., more preferably at 65 to 75° C. By drying the pulverized product in this temperature range, it is possible to reach a desired amount of moisture while avoiding dissipation of the required flavor component. That is, if it is less than 60° C., it takes a long time to reach a desired moisture amount, and if it exceeds 80° C., the required flavor component dissipates. Then, the moisture content of the non-tobacco plant after drying and pulverizing is preferably set to 0.1 to 5% by mass, more preferably 0.1 to 3% by mass or less. At least a constant amount of water is required because affinity with water or the like is necessary for slurring. Providing a classification step of sieving the pulverized product in the drying and pulverizing step not only further facilitates slurring, but it is also possible to produce a slurry in a preferred state.

In the preparation step, an aerosol former, a microcrystalline cellulose, a crosslinked polyvinylpyrrolidone, a β-cyclodextrin, a thickener, a flavor, an antibacterial preservative, water, an alcohol, or the like, which are the raw materials other than the non-tobacco plant, necessary for producing the noodle-shaped aroma-producing substrate to be heated 23, are weighed and introduced into the mixing step. A water obtained by sterilizing or removing microorganisms, pure water obtained by ion exchange or a reverse osmosis film, or the like is used as the water in the present embodiment.

In the mixing step, wet mixing is performed. For example, a conventional wet mixer in which a raw material in a mixing tank is mixed with a stirring blade while applying a shearing force, for example, a Henschel mixer or the like is preferably used in the mixing step. In the case of high viscosity, a Banbury mixer using a rotor, a kneader using a blade, or the like is preferably used.

In the molding step in the present embodiment, a method of molding and processing a rectangular noodle-shaped aroma-producing substrate to be heated 23 that is long in the longitudinal direction and is used as a raw material for manufacturing the aroma-producing body to be heated 2 will be described as a representative example. However, the shape of the noodle-shaped aroma-producing substrate to be heated is not limited thereto. The molding method described below is also an example and is not limited to this method.

First, the composition in which various raw materials are mixed is molded into a thin sheet by a three-roll mill. The three roll-mill can make a sheet of a desired thickness by a doctor blade while kneading and dispersing or the like by compressive force pushed between narrow rolls and the shearing force due to the roll speed difference. The three-roll mill is preferred as a processing machine for molding a slurry in which various raw materials such as the present invention are dispersed into a sheet. A press roller or a press machine may be used in this final finish. The three-roll mill is capable of not only molding but also kneading and dispersing. For this reason, it is also possible to further add a non-tobacco plant, an aerosol former, a binding agent, a flavoring agent, an antibacterial preservative, water, or the like, if necessary, and to form a desired heated aroma-producing sheet while adjusting the viscosity and the blending amount. As described above, a method of molding and processing into a sheet is not limited thereto, and a method of molding a slurry by passing through an orifice by pressure is also preferably used.

The thickness of the heated aroma-producing sheet to be molded in the molding step is preferably in a range of 0.1 to 1.0 mm, and more preferably in a range of 0.1 to 0.5 mm.

The heated aroma-producing sheet produced in this way is cut to a predetermined width by a cutter, or a rotary blade type rotary cutter, or the like in the cutting step, and the noodle-shaped aroma-producing substrate to be heated 23 is produced.

Figure 3A:
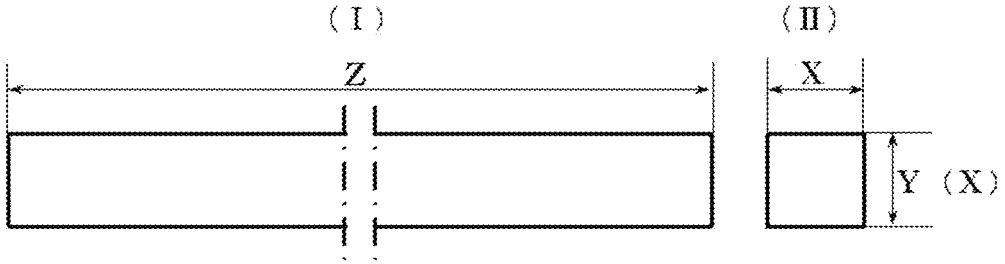
FIGS. 3A and 3B are schematic diagrams showing an example of a shape of a noodle-shaped aroma-producing substrate to be heated wound up by a heated aroma-producing packaging material web roll to produce an aroma-producing body to be heated having a deformed gas flow path of the present invention. (I) is a schematic view of a side surface on the long axis side when viewed from a direction perpendicular to the longitudinal direction of the noodle-shaped body, and (II) is a schematic view of a cross-section cut at a right angle to the longitudinal direction of the noodle-shaped body.
Figure 3B:
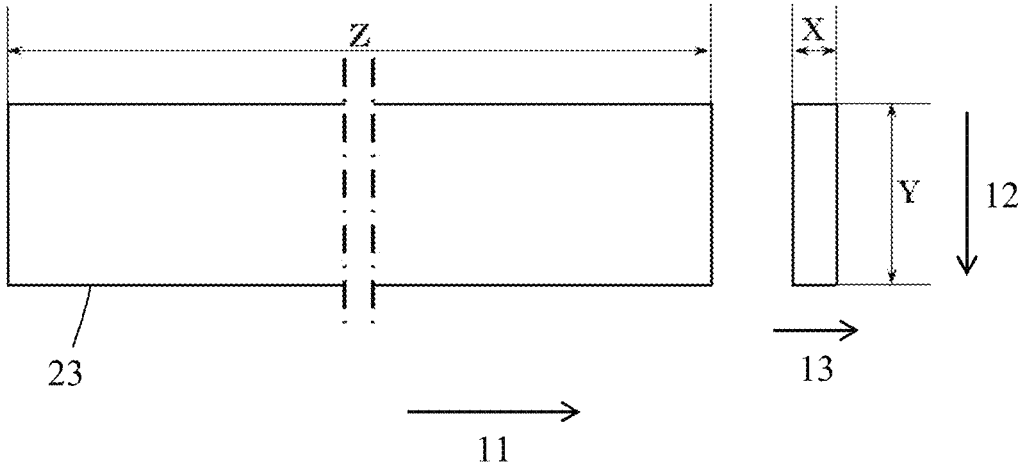

In the present embodiment, cutting of the heated aroma-producing sheet having a thickness of 0.3 mm will be described as an example. First, the formed heated aroma-producing sheet is cut into a rectangle having a length of 150 mm and a width of 240 mm. The rectangular heated aroma-producing sheet is supplied to a rotary cutter to obtain a sheet cut material having a shape of 1.5 mm in length and 240 mm in width, that is, the noodle-shaped aroma-producing substrate to be heated 23 supplied for manufacturing the aroma-producing body to be heated 21. This noodle-shaped aroma-producing substrate to be heated 23 is shown in FIG. 3B. In this case, the length X of the short axis of the cross-section perpendicular to the longitudinal direction of the noodle-shaped aroma-producing substrate to be heated 23 is 0.3 mm, the length Y of the long axis is 1.5 mm, and the length Z of the longitudinal direction is 240 mm. The aspect ratio of the length of the long axis and the length of the short axis in the noodle-shaped aroma producing substrate 23 is Y:X=5:1, the aspect ratio of the length of the longitudinal direction and the length of the short axis is Z:X=800:1.

However, the noodle-shaped aroma-producing substrate to be heated 23 is not limited to the substantially rectangular shape shown in FIG. 3B. The perpendicular cross-section of the noodle-shaped aroma-producing substrate to be heated 23 may be substantially square, that is, the aspect ratio between the length of the short axis and the length of the long axis may be 1:1.

Figure 4A:
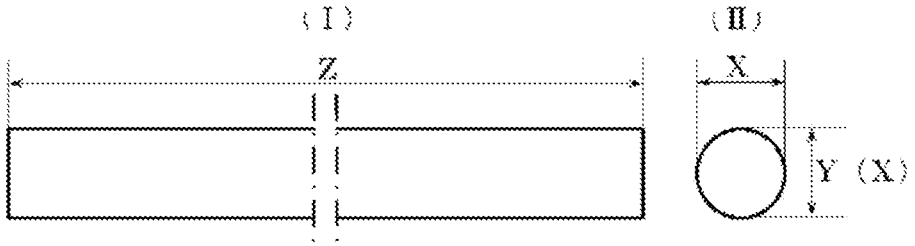
FIGS. 4A and 4B are schematic diagrams showing an example of a shape of a noodle-shaped aroma-producing substrate to be heated wound up by a heated aroma-producing packaging material web to produce an aroma-producing body to be heated having a deformed gas flow path of the present invention. (I) is a schematic view of a side surface on the long axis side when viewed from a direction perpendicular to the longitudinal direction of the noodle-shaped body, and (II) is a schematic view of a cross-section cut at a right angle to the longitudinal direction of the noodle-shaped body. It is a front view of a tobacco filling aggregate.
Figure 4B:
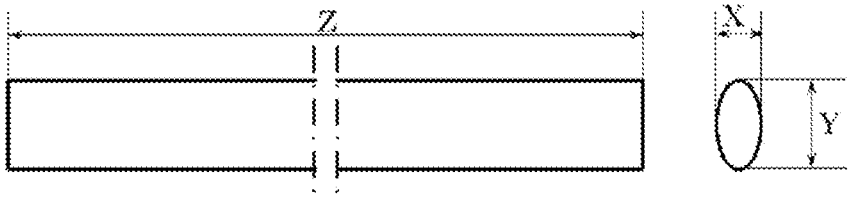

As shown in FIGS. 4A and 4B, it is also possible to use a noodle-shaped aroma-producing substrate to be heated 23 having a circular cross-section and an elliptical cross-section, respectively. However, in the case of such a shape, it is possible to use the heated aroma-producing sheet and manufacture it by extrusion molding using a circular die and an elliptical die, and an extruded noodle making machine, or the like.

Figure 5:
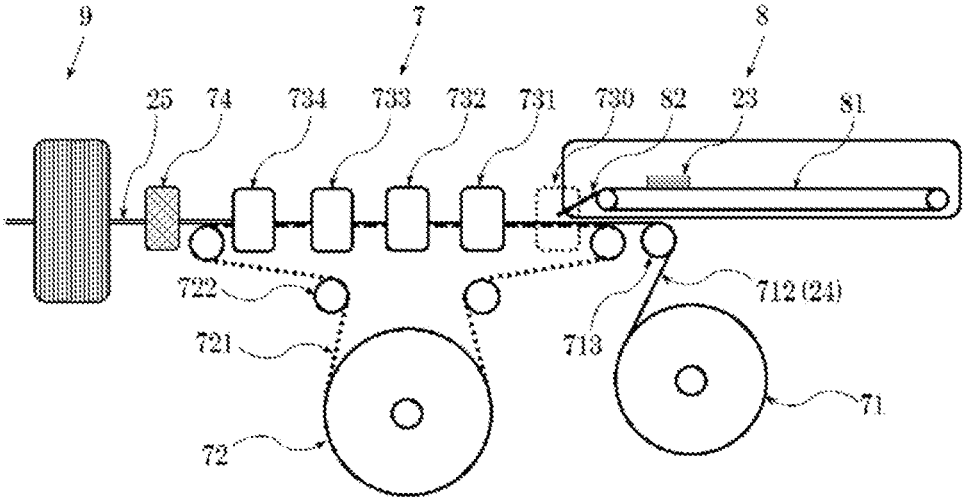
FIG. 5 is a schematic diagram showing a manufacturing method and a device of an aroma-producing body to be heated by winding up a noodle-shaped aroma-producing substrate to be heated with a packaging material web of the aroma-producing body to be heated.

In FIG. 5, fifty noodle-shaped heated aroma-producing bodies 23 having the shape shown in FIG. 3B and having Y:X=5:1 and Z:X=800:1 were used to produce the aroma-producing body to be heated 21 provided in the aroma cartridge 1 as shown in FIG. 1.

An outline of the manufacturing method of the aroma-producing body to be heated 21 using such a noodle-shaped aroma-producing body to be heated 23 and the manufacturing device is schematically shown in FIG. 6. This is a method and device for manufacturing the aroma-producing body to be heated 21 by placing the noodle-shaped aroma-producing substrate to be heated 23, which is formed by cutting the heated aroma-producing sheet, on the longitudinal direction of a packaging material web of the aroma-producing body to be heated 712, continuously winding up the noodle-shaped aroma-producing substrate to be heated 23 and cutting a wound up rod-shaped aroma-producing body to be heated 25.

The noodle-shaped aroma-producing substrate to be heated 23 formed by cutting the heated aroma-producing sheet has been put into a conveyor 81 of the Feeding unit of Noodle-shaped aroma-producing substrate to be heated 8 so that the longitudinal direction of the noodle-shaped aroma-producing substrate to be heated 23 and the moving direction of the conveyor 81 are parallel to each other. In this case, via the conveyor 81 and a transfer device of noodle-shaped aroma-producing substrate to be heated 82, the noodle-shaped aroma-producing substrate to be heated 23 is transferred onto the packaging material web of the aroma-producing body to be heated 712 at a receiving unit of Noodle-shaped aroma-producing substrate to be heated 730 of a winding unit 7 so that the longitudinal direction of the packaging material web of the aroma-producing body to be heated 712 supplied from a packaging material of the aroma-producing body to be heated feeding unit 71 becomes parallel to the longitudinal direction of the noodle-shaped aroma-producing substrate to be heated 23. The packaging material web of the aroma-producing body to be heated 712 is supported and conveyed by an endless stringer tape 721 supplied from a stringer tape feeding unit 72. In this way, the noodle-shaped aroma-producing substrate to be heated 23 which is placed on the packaging material web of the aroma-producing body to be heated 712 and supported and conveyed by the stringer tape 721 passes through winding guides (1) to (4) which include a groove in which the stringer tape 721 is bent from a direction perpendicular to the conveyance direction together with the heated aromatic biogenic packaging material web 712. The noodle-shaped aroma-producing substrate to be heated 23 is wound up to become a cylindrical rod-shaped aroma-producing body to be heated 25. The cylindrical rod-shaped aroma-producing body to be heated 25 is cut to a predetermined length by a cutting unit 9 and the aroma-producing body to be heated 2 is manufactured. A method of linearly bonding a packaging material of the rod-shaped aroma-producing body to be heated 25 in a conveying direction is performed by applying a hot melt adhesive to a predetermined position of the packaging material web of the aroma-producing body to be heated 712 in advance, winding it, and then passing it through a heating and bonding unit 74.

The filling structure of the aroma-producing substrate to be heated 21 inside the aroma-producing body to be heated 2 bundled by the packaging material of the aroma-producing body to be heated 22, which is manufactured in this manner, that is, the deformed gas flow path, is formed by passing the packaging material web of the aroma-producing body to be heated 712 on which the noodle-shaped aroma-producing substrate to be heated 23 is placed, together with the stringer tape 721, through winding guides (1) 731 to (4) 734, which are installed in the winding unit 7 and have different groove depths.

FIGS. 6A to 6E show a state in which the deformed gas flow path of the aroma-producing substrate to be heated 21 inside the aroma-producing body to be heated 2 bundled by the packaging material of the aroma-producing body to be heated 22 is formed. The winding guides (1) 731 to (4) 734 are shaped in a cross-section cut perpendicular to the conveying direction, and the depth of the groove becomes deeper. The noodle-shaped aroma-producing substrate to be heated 23 is fully wound in the winding guide (4) 731 according to the conveying direction.

Figure 6A:
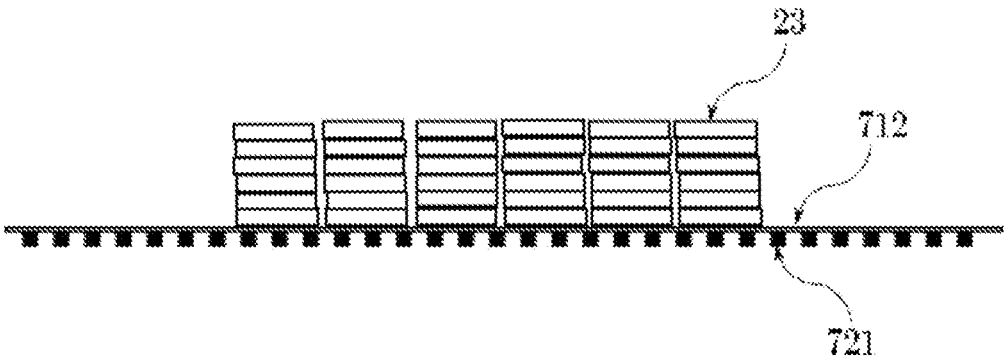
FIG. 6A is a schematic diagram showing a mechanism in which a noodle-shaped aroma-producing substrate to be heated forms a deformed gas flow path in a step of winding up the noodle-shaped aroma-producing substrate to be heated with a packaging material web of the aroma-producing body to be heated.

FIG. 6A shows a state in which the noodle-shaped aroma-producing substrate to be heated 23 is transferred from the conveyor 81 via a transfer device of noodle-shaped aroma-producing substrate to be heated 82 onto the noodle-shaped packaging material web of the aroma-producing body to be heated 712 by the receiving unit of Noodle-shaped aroma-producing substrate to be heated 730 of the winding unit 7 so that the longitudinal direction of the packaging material web of the aroma-producing body to be heated 712 supplied from the packaging material of the aroma-producing body to be heated feeding unit 71 becomes parallel to the longitudinal direction of the noodle-shaped aroma-producing substrate to be heated 23. Actually, although not clearly depicted in FIG. 6A, the noodle-shaped aroma-producing substrate to be heated 23 is stacked in a substantially aligned manner.

Figure 6B:
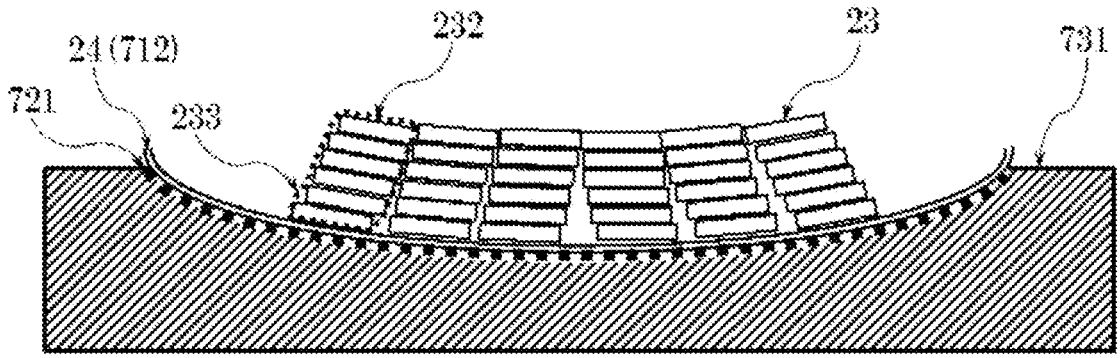
FIG. 6B is a schematic diagram showing a mechanism in which a noodle-shaped aroma-producing substrate to be heated forms a deformed gas flow path in a step of winding up the noodle-shaped aroma-producing substrate to be heated with a packaging material web of the aroma-producing body to be heated.

FIG. 6B shows a state in which the noodle-shaped aroma-producing substrate to be heated 23 passes through the winding guide (1) 731 having a shallow groove like a crescent moon. When the noodle-shaped aroma-producing substrate to be heated 23 that has been aligned and stacked on the packaging material web of the aroma-producing body to be heated 712 passes through the groove together with the stringer tape 721, the stringer tape 721 and the packaging material web of the aroma-producing body to be heated 712 are bent along the groove in the perpendicular direction with respect to the conveying direction, a noodle-shaped primary aggregate of the aroma-producing substrate to be heated 232 is formed so that the noodle-shaped aroma-producing substrate to be heated 23 is collapsed, and gas flow path formed by a primary aggregate of the noodle-shaped aroma-producing substrate to be heated starts to be formed.

Figure 6C:
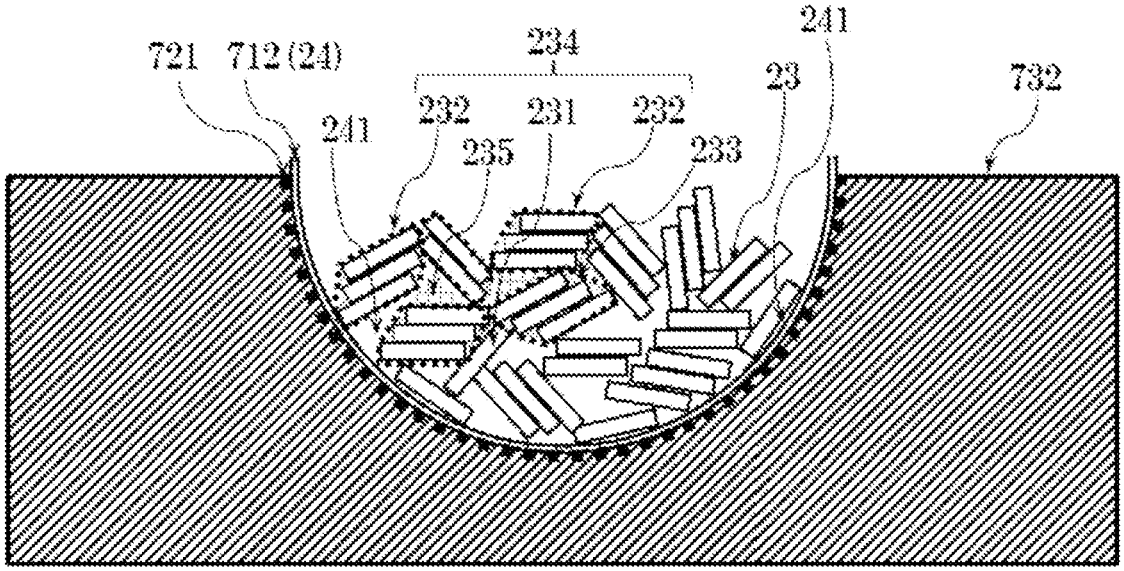
FIG. 6C is a schematic diagram showing a mechanism in which a noodle-shaped aroma-producing substrate to be heated forms a deformed gas flow path in a step of winding up the noodle-shaped aroma-producing substrate to be heated with a packaging material web of the aroma-producing body to be heated.

FIG. 6C shows a state in which the noodle-shaped aroma-producing substrate to be heated 23 passes through the winding guide (2) 732 of the groove having a depth of about a half moon. The stringer tape 721 and the packaging material web of the aroma-producing body to be heated 712 are largely bent along the grooves in the direction perpendicular with respect to the conveying direction, and the noodle-shaped aroma-producing substrate primary aggregates 232 are formed successively. A number of gas flow paths formed by noodle-shaped primary aggregates of the aroma-producing substrate to be heated 233 are formed in each of them. At the same time, pairs of the primary aggregates of the noodle-shaped aroma-producing substrate to be heated 232, or the primary aggregate of the noodle-shaped aroma-producing substrate to be heated 232 and a noodle-shaped single body of the aroma-producing substrate to be heated 231, and the like form a noodle-shaped secondary aggregate of the aroma-producing substrate to be heated 234. A large gas flow path formed by noodle-shaped secondary aggregate of the aroma-producing substrate to be heated 235 starts to be formed between the primary aggregate of the noodle-shaped aroma-producing substrate to be heated 232 and between the primary aggregate of the noodle-shaped aroma-producing substrate to be heated 232 and the single body of the noodle-shaped aroma-producing substrate to be heated 231. In the outer periphery region, gas flow path formed by a packaging material web of the aroma-producing body to be heated 241 is also formed between the single body of the noodle-shaped aroma-producing substrate to be heated 231 and the primary aggregate of the noodle-shaped aroma-producing substrate to be heated 232, and the packaging material web of the aroma-producing body to be heated 712.

Figure 6D:
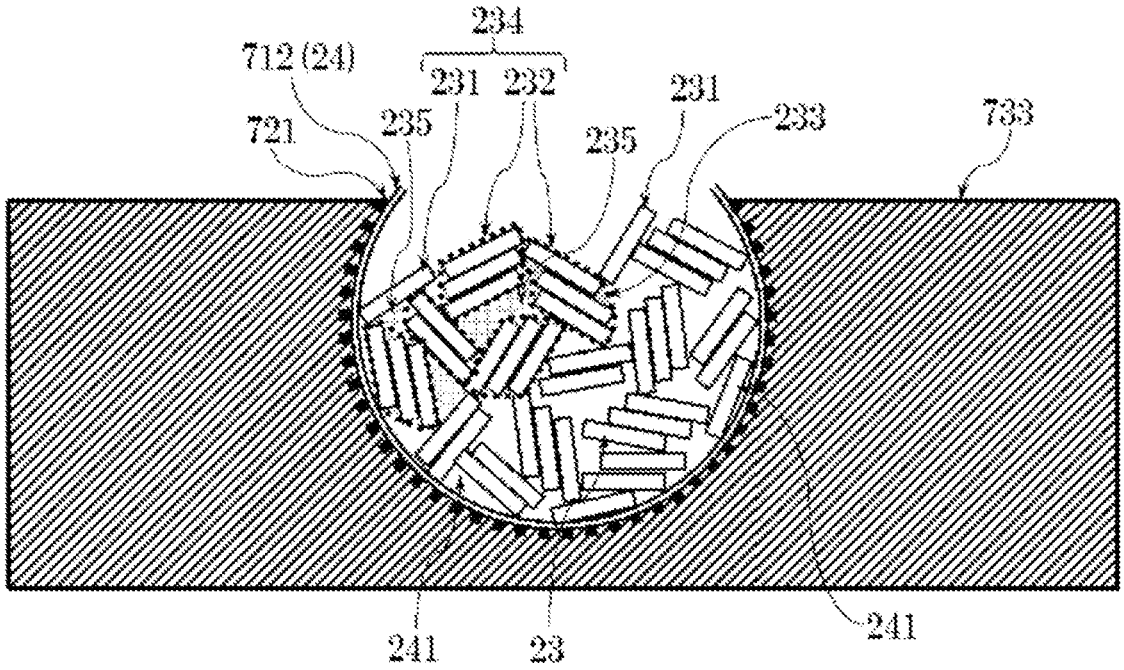
FIG. 6D is a schematic diagram showing a mechanism in which a noodle-shaped aroma-producing substrate to be heated forms a deformed gas flow path in a step of winding up the noodle-shaped aroma-producing substrate to be heated with a packaging material web of the aroma-producing body to be heated.

Further, in FIG. 6D, when the noodle-shaped aroma-producing substrate to be heated 23 passes through the winding guide (3) 733 of the groove having a shape of the nearly a full moon, the state in FIG. 6C progresses, so that the stringer tape 721 and the aroma-producing body to be heated package material web 712 draw a circumference in the direction perpendicular to the conveying direction along the groove. In the outer peripheral region thereof, the noodle-shaped aroma-producing substrate to be heated 23 constituting the primary aggregate of the noodle-shaped aroma-producing substrate to be heated 232 and the secondary aggregate of the noodle-shaped aroma-producing substrate to be heated 234 moves while sliding. As the frequency in which the surface of the long-axis direction in the cross-section perpendicular to the noodle-shaped aroma-producing substrate to be heated 23 contacts with the surface of the long-axis direction in the perpendicular cross-section of the adjacent noodle-shaped aroma-producing substrate to be heated 23 increased, the number of noodle-shaped aroma-producing substrates to be heated 23 in which the long axis direction is arranged tangentially with respect to the circumference also increases, and the filling rate of the noodle-shaped aroma-producing substrate to be heated 23 in the outer peripheral region begins to increase. On the other hand, in the center region, the primary aggregate of the noodle-shaped aroma-producing substrate to be heated 232 and the secondary aggregate of the noodle-shaped aroma-producing substrate to be heated 234 remain. Therefore, gas flow path formed by the noodle-shaped aroma-producing substrate primary aggregate 233 and gas flow path formed by the noodle-shaped aroma-producing substrate secondary aggregate 235 are not greatly reduced, and the number of voids starts to become larger than in the outer periphery region.

Figure 6E:
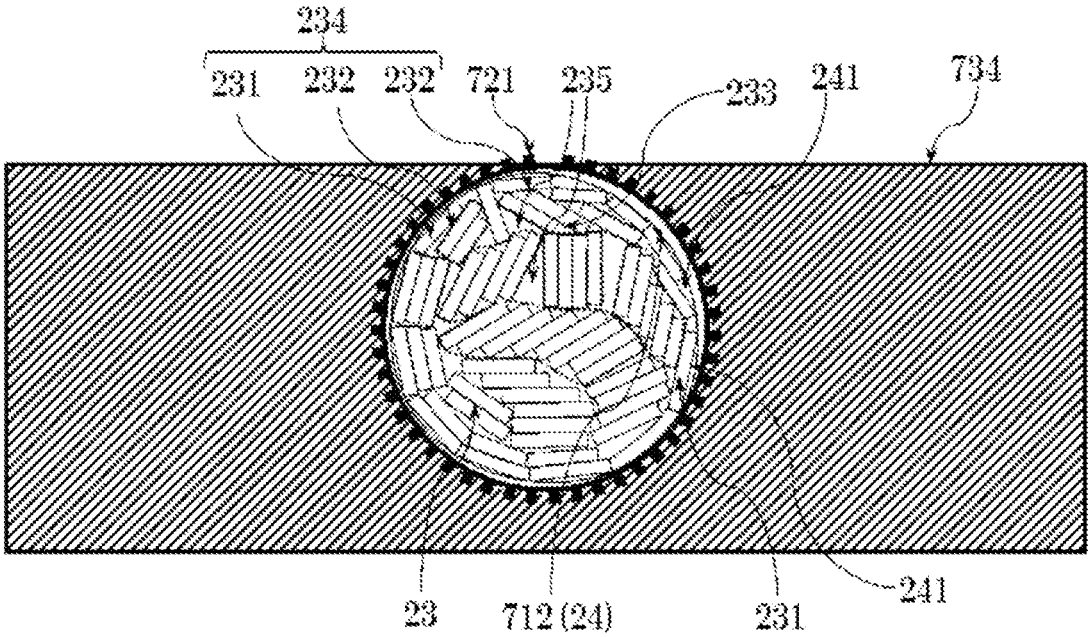
FIG. 6E is a schematic diagram showing a mechanism in which a noodle-shaped aroma-producing substrate to be heated forms a deformed gas flow path in a step of winding up the noodle-shaped aroma-producing substrate to be heated with a packaging material web of the aroma-producing body to be heated.

Next, in FIG. 6E, the stringer tape 721 and the packaging material web of the aroma-producing body to be heated 712 are completely wound along the grooves in the direction perpendicular with respect to the conveying direction, and the rod-shaped aroma-producing body to be heated 25 is formed. In this state, the state of FIG. 6D further progresses, and the inner structure of the rod-shaped aroma-producing body to be heated 25 is fixed. That is, in the center region of the rod-shaped aroma-producing body to be heated 25, the bulky noodle-shaped primary aggregate of the aroma-producing substrate to be heated 232 and the secondary aggregate of the noodle-shaped aroma-producing substrate to be heated 234 remain, and gas flow path formed by the noodle-shaped heated aroma-producing base primary aggregate 233 and gas flow path formed by the secondary aggregate of the noodle-shaped aroma-producing substrate to be heated 235 existing therein have a high porosity and a deformed gas flow path is secured. On the other hand, the outer periphery region also forms gas flow path formed by the packaging material web of the aroma-producing body to be heated 241 between the noodle-shaped aroma-producing substrate material single body 231 and the noodle-shaped aroma-producing substrate primary aggregate 232 and the packaging material web of the aroma-producing body to be heated 712. However, the noodle-shaped aroma-producing substrate 23 constituting the noodle-shaped aroma-producing substrate material primary aggregate 232 and the secondary aggregate of the noodle-shaped aroma-producing substrate to be heated 234 moves while sliding. Therefore, as the frequency of the contact between the surface in the long-axis direction of the cross-section perpendicular with respect to the noodle-shaped aroma-producing substrate to be heated 23 and the surface in the long-axis direction of the perpendicular cross-section of the adjacent noodle-shaped aroma-producing substrate to be heated 23 increases, the number of noodle-shaped aroma-producing substrates to be heated 23 in which the long axis direction is arranged in the tangential direction of the circumference is also large, and the filling rate of the noodle-shaped aroma-producing substrate to be heated 23 of the outer peripheral region increases. Therefore, a stable and strong structure is formed.

The inner structure of the rod-shaped aroma-producing body to be heated 25 is a structure of a cross-section perpendicular to its longitudinal direction, and the cross-section perpendicular with respect to the longitudinal direction of the noodle-shaped aroma-producing substrate to be heated 23 is uniformly generated in the longitudinal direction, so that the structure of the cross-section perpendicular with respect to the longitudinal direction of the rod-shaped aroma-producing body to be heated 25 is uniform, and the deformed gas flow paths (233, 235 and 241) such as gas flow path 233 formed by the primary aggregate 232 of the noodle-shaped aroma-producing substrate to be heated 233, gas flow path 235 formed by the noodle-shaped aroma-producing substrate secondary aggregate 234-235, and gas flow path 241 formed by the packaging material web of the aroma-producing body to be heated 241 penetrate the longitudinal direction of the rod-shaped aroma-producing body to be heated 25. Accordingly, the inner structures of the aroma-producing body to be heated 2 produced by cutting the rod-shaped aroma-producing body to be heated 25 and the rod-shaped aroma-producing body to be heated 25 are the same.

Figure 7:
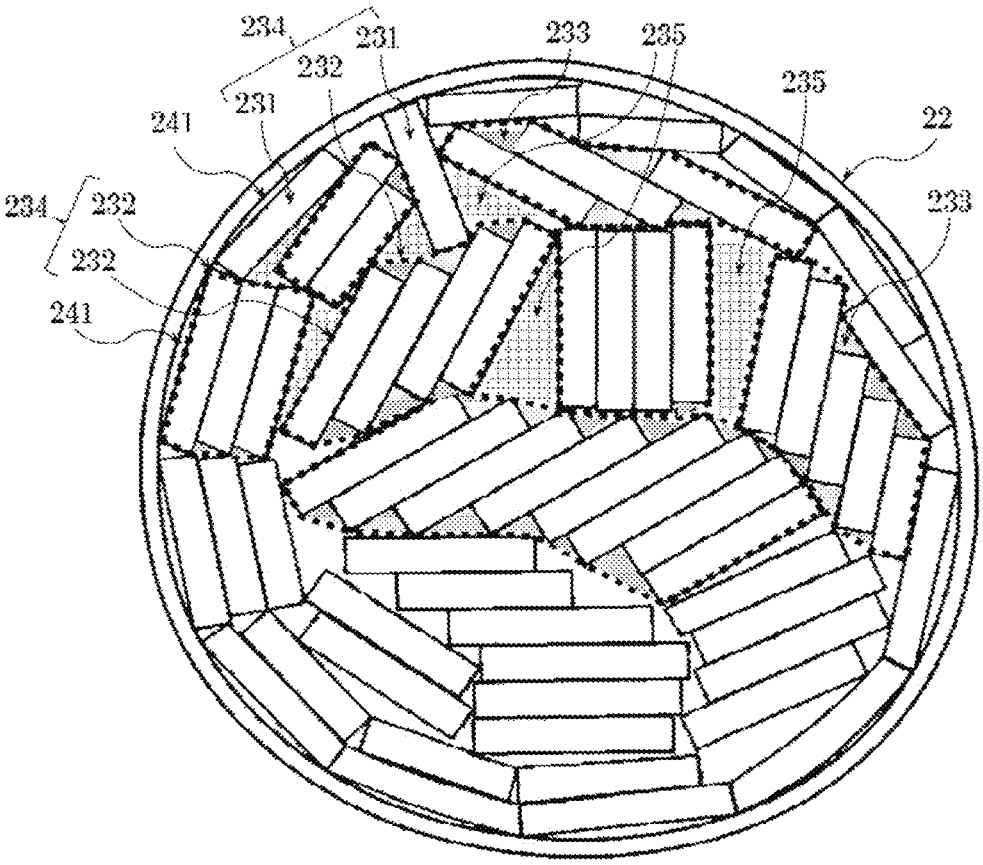
FIG. 7 is a schematic diagram of a cross-section of an aroma-producing body to be heated having a deformed gas flow path, cut at a right angle to the longitudinal direction in the case where the cross-section of the aroma-producing substrate to be heated constituting the aroma-producing body to be heated is substantially rectangular, according to an embodiment of the present invention.

FIG. 7 shows an enlarged view of a cross-section perpendicular to the longitudinal direction of the aroma-producing body to be heated 2. This is exactly the same as the cross-sectional view of FIG. 6E and has the same structure. Accordingly, when smoking is performed using the aroma cartridge 1 provided with the aroma-producing body to be heated 2, the problem of the conventional aroma cartridge is eliminated, and the smoke and aroma of the aerosol can be sufficiently inhaled into the oral cavity of the smoker, so that comfortable smoking can be achieved. In addition, the filling rate of the aroma-producing substrate to be heated in the outer peripheral region is higher than that in the center region, thereby forming a strong structure against the pressures from an end part and the outer peripheral part of the aroma-producing body to be heated. Therefore, the aroma-producing substrate to be heated does not fall off when the aroma cartridge is attached/detached, and the appropriate number of inhaling per one piece of tobacco is secured, and also, the problem of combustion of the aroma-producing substrate to be heated at the time of suction does not occur. In addition, the lower filling rate in the center region facilitates insertion of the aroma cartridge into the heating element of the heated aroma device.

The aroma-producing body to be heated 2 produced in the present embodiment was finished to an outer shape of about 6.9 mm and a length of 12.0 mm by winding fifty pieces of the noodle-shaped aroma-producing substrate to be heated 23 with the packaging material web of the aroma-producing body to be heated 712 and cutting in the cutting unit 9, and the weight thereof was 0.29 g, the volume filling rate of the aroma-producing substrate to be heated 21 with respect to the volume of the aroma-producing body to be heated 2 was about 0.60, and the density of the aroma-producing body to be heated 2 was 1.07 g/cm$^3$. In addition, the aroma cartridge 1 shown in FIG. 1, which was manufactured using this, was sufficiently adapted to a commercially available heated aroma device.

Figure 8A:
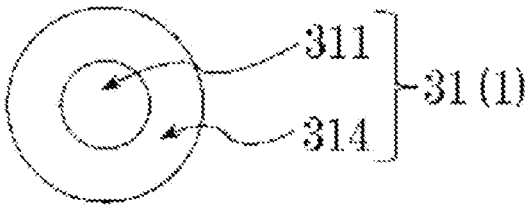
FIGS. 8A, 8B, and 8C is a schematic diagram of a cross-section of a support member applied to an aroma cartridge provided with an aroma-producing body to be heated having a deformed gas flow path, and cut at a right angle to the longitudinal direction, according to an embodiment of the present invention.

Here, the support member 31, which constitutes the mouthpiece 3 used in the aroma cartridge 1 shown in FIG. 1, will be described. FIG. 8 is a schematic view of a cross-section perpendicular with respect to the longitudinal direction of the support member. In FIG. 1, the hollow cylindrical support member 31 (1) shown in FIG. 8A is used. The support member 31 (1) includes a hollow part which is the gas flow path (1) 311, and an outer peripheral part which is in contact with the packaging material of the aroma-producing body to be heated 22 and a support unit (1) 314 which prevents the aroma-producing body to be heated 2 from moving toward the mouthpiece side.

Figure 8B:
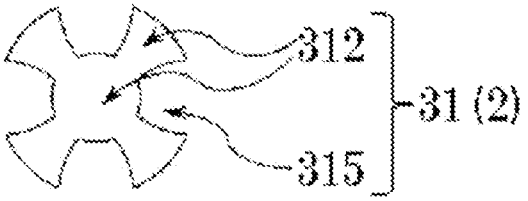
Figure 8C:
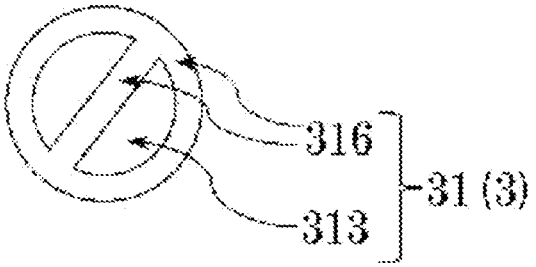

The aroma-producing body to be heated 2 having the deformed gas flow path of the present invention allows for enjoyment of a more pleasant smoking experience than ever before. However, the use of the support members 31 (2) and 31 (3) of FIGS. 8B and 8C is preferred in combination with the aroma-producing body to be heated 2 of the present invention because further improvements can be made by altering the construction of the support member 31. FIG. 8B shows a gas flow path (2) 312 formed between a support unit (2) 315 in which four projections are provided from the center to the outer periphery in the support member 31 (2) and the projections. FIG. 8C shows the hollow cylindrical support member 31 (3). The outer peripheral part and a barrier provided in the hollow part form a support unit (3) 316. The hollow part, which includes the barrier, is a gas flow path (3) 313.

Although the embodiments of the present invention have been described above, the present invention is not limited to the present embodiment and can be variously applied within the scope of the technical idea described in the claims. For example, in the present embodiment, only the support member 31 is provided between the aroma-producing body to be heated 2 and the filter 32. However, a cooling member may be provided between the support member 31 and the filter 32.

What is claimed is:

1. An aroma-producing body to be heated loaded into an aroma cartridge, the aroma-producing body comprising:

an aroma-producing substrate to be heated, the aroma-producing substrate producing smoke and aromas when heated in contact with a heating element; and a packaging material surrounding the aroma-producing substrate, wherein the aroma-producing substrate contains at least an aerosol former, non-tobacco plants and/or tobacco plants, and a binding agent, the aroma-producing substrate includes noodle-shaped bodies, the noodle-shaped bodies include aggregates in which part of the noodle-shaped bodies are aggregated and single pieces that are not aggregated, the aroma-producing body has a deformed gas flow path penetrating the aroma-producing body in a longitudinal direction of the aroma-producing body, the deformed gas flow path includes a first gas flow path between the aggregates, and a second gas flow path between the single pieces or the aggregates and the packaging material, the noodle-shaped bodies have anisotropy in a cross-sectional shape perpendicular to the longitudinal direction, the cross-sectional shape having a long axis direction and a short axis direction, and in a cross-section perpendicular to the longitudinal direction, a ratio of the noodle-shaped bodies having the long axis direction along a periphery of the aroma-producing substrate to all of the noodle-shaped bodies is greater than a ratio of the noodle-shaped bodies having the long axis direction along a normal direction of the periphery of the aroma-producing substrate to all of the noodle-shaped bodies.

2. The aroma-producing body to be heated according to claim 1, wherein a central region has a higher porosity than a peripheral region when the central region and the peripheral region are equally divided by area in the cross-section perpendicular to the longitudinal direction of the aroma-producing body.

3. The aroma-producing body to be heated according to claim 1, wherein in the cross-sectional shape of each of the noodle-shaped bodies, a ratio between a length of a long axis and a length of a short axis is 1:1 to 30:1, and in each of the noodle-shaped bodies, a ratio between a length of the longitudinal direction and the length of the short axis is 10:1 to 700:1.

4. The aroma-producing body to be heated according to claim 3, wherein each of the noodle-shaped bodies is approximately a rectangular body.

5. The aroma-producing body to be heated according to claim 4, wherein the length of the longitudinal direction of the rectangular body is 10 to 70 mm, the length of the short axis of the rectangular body is 0.1 to 1.0 mm, and the length of the long axis of the rectangular body is 0.5 to 3.0 mm.

6. An aroma cartridge comprising:

the aroma-producing body to be heated according to claim 1.

7. The aroma cartridge according to claim 6 further comprising:

a support member adjacent to the aroma-producing body in the longitudinal direction and allowing airflow to pass along the longitudinal direction; and a filter adjacent to the support member in the longitudinal direction.

8. The aroma cartridge according to claim 7, wherein the support member has a support unit provided at least at an outermost periphery of the support member, the support unit preventing the aroma-producing body from moving toward a mouthpiece of the aroma cartridge.

* * * * *